US011832707B2

(12) United States Patent
Suzuki

(10) Patent No.: US 11,832,707 B2
(45) Date of Patent: Dec. 5, 2023

(54) CARTRIDGE-TYPE CONTENT EXTRUSION CONTAINER WITH SCREW LOCKING MEMBER

(71) Applicant: TOKIWA CORPORATION, Nakatsugawa (JP)

(72) Inventor: Takumi Suzuki, Kawaguchi (JP)

( * ) Notice: Subject to any disclaimer, the term of this patent is extended or adjusted under 35 U.S.C. 154(b) by 0 days.

(21) Appl. No.: 18/062,587

(22) Filed: Dec. 7, 2022

(65) Prior Publication Data

US 2023/0189962 A1 Jun. 22, 2023

(30) Foreign Application Priority Data

Dec. 17, 2021 (JP) ..... 2021-205166

(51) Int. Cl.
*A45D 34/04* (2006.01)
*A45D 34/00* (2006.01)

(52) U.S. Cl.
CPC ..... *A45D 34/04* (2013.01); *A45D 34/042* (2013.01); *A45D 2034/005* (2013.01); *A45D 2200/1072* (2013.01)

(58) Field of Classification Search
CPC ..... A45D 34/04; A45D 2200/1072; A45D 2034/005; A45D 40/02; A45D 40/06; A45D 34/00; A45D 34/042
USPC ..... 401/268, 270, 271, 275, 282
See application file for complete search history.

(56) References Cited

U.S. PATENT DOCUMENTS

2005/0186020 A1* 8/2005 Tani ..... B43K 8/04 401/282
2013/0279965 A1* 10/2013 Tani ..... B65D 83/0005 401/172
2019/0298034 A1* 10/2019 Nakamura ..... A45D 34/042

FOREIGN PATENT DOCUMENTS

JP 2015-181862 10/2015

* cited by examiner

*Primary Examiner* — David J Walczak
(74) *Attorney, Agent, or Firm* — SOEI PATENT & LAW FIRM

(57) ABSTRACT

A cartridge-type content extrusion container includes a cartridge containing a material and forming an opening, a main body tube to removably accommodate the cartridge, a screw tube inside the main body tube, a moving body that is screwed into the screw tube to move in an axial direction of the main body tube via a rotation of the moving body relative to the screw tube, so as to urge the material toward the opening of the cartridge, and a screw locking member. The screw tube has an elastic portion that is accommodated in the screw locking member. The screw locking member is movable away from the screw tube when the cartridge is removed from the main body tube to cause the elastic portion to expand in the radial direction so as to release a screw coupling between the screw tube and the moving body.

9 Claims, 13 Drawing Sheets

CARTRIDGE-TYPE CONTENT EXTRUSION CONTAINER WITH SCREW LOCKING MEMBER

CROSS-REFERENCE TO RELATED APPLICATIONS

This application claims the benefit of priority from Japanese Patent Application No. 2021-205166, filed Dec. 17, 2021, the entire contents of which are incorporated herein by reference.

BACKGROUND

Japanese Unexamined Patent Publication No. 2015-181862 discloses a cartridge-type content extrusion container including a cartridge accommodating a liquid cosmetic material, a main body tube to which the cartridge is attached, and an operation tube attached to a rear end of the main body tube so as to be relatively rotatable.

Inside the main body tube, a moving body having a male screw on an outer circumference, a female screw member having a female screw screwed with the male screw, and a screw release member releasing screwing between the male screw and the female screw are provided. The screw release member releases the screwing between the male screw and the female screw when the cartridge is removed from the main body tube, and the screw release member forces the screwing of the female screw with the male screw when the cartridge is attached to the main body tube.

When the main body tube or cartridge and the operation tube are relatively rotated by the user, the moving body moves forward. The cartridge has a cartridge tube in which an accommodation chamber for accommodating the liquid cosmetic material is formed inside, a coating body constituting a distal end of the cartridge, and a piston provided on the side opposite to the coating body in the accommodation chamber. The moving body abuts on the piston, and the moving body pushes the piston forward by the relative rotation operation described above, so that the liquid cosmetic material is extruded.

In the cartridge-type content extrusion container described above, the moving body advances and the liquid cosmetic material are extruded by the relative rotation operation of the main body tube or the cartridge and the operation tube. This type of cartridge-type content extrusion container requires operation with both hands. Specifically, it is necessary to hold the main body tube or the cartridge with one hand and hold the operation tube with the other hand to rotate the operation tube relative to each other.

SUMMARY

A cartridge-type content extrusion container according to the present disclosure is provided with: a cartridge unit containing a content (e.g., a material); a main body tube on which the cartridge unit is detachably attached; a screw tube provided inside the main body tube, having an elastic portion elastically deformed in a radial direction of the main body tube, and having a female screw (or female screw thread) formed on an inner surface of the elastic portion; a moving body having a male screw (or male screw thread) screwed into the female screw on an outer circumference and advancing by a screwing function of the female screw and the male screw to extrude the content; a screw adjusting member (or screw locking member) advancing when the cartridge unit is removed from the main body tube and expanding the elastic portion of the screw tube in the radial direction to release the screwing between the female screw and the male screw; a rotating member rotating synchronously with the moving body behind the screw tube and moving along the axial direction in which an axial line of the main body tube extends; a knock member (or knock actuator) provided on a rear side of the rotating member and that may be pressed on to extrude the content; and a plurality of first teeth provided in front of the rotating member inside the main body tube and aligned along a circumferential direction of the main body tube. The rotating member has a plurality of second teeth that are aligned along the circumferential direction and engaged with the first teeth. When the knock member is pressed, the rotating member advances to allow the second teeth to be engaged with the first teeth, and the rotating member and the moving body rotate with respect to the screw tube, so that the screwing function works to allow the moving body to advance.

This cartridge-type content extrusion container includes a cartridge unit accommodating the content and a main body tube to which the cartridge unit is attached, and the cartridge unit is removably attached to (e.g., attachable to and detachable from) the main body tube. Therefore, after the content are used up, it is preferable that the cartridge unit is removed from the main body tube and only the cartridge unit is discarded, so that the number of discarded components can be reduced. The cartridge-type content extrusion container has a screw tube having an elastic portion elastically deformed in the radial direction, a moving body having a male screw screwed into a female screw of the screw tube and advancing to extrude the content inside the cartridge unit, a rotating member rotating synchronously with the moving body, and a knock member that is pressable.

The rotating member has second teeth that are engaged with first teeth provided inside the main body tube. When the knock member is pressed, by allowing the rotating member to advance, the second teeth are engaged with the first teeth, and by allowing the rotating member and the moving body to rotate with respect to the screw tube, the moving body advances. Therefore, the rotating member and the moving body rotate with respect to the screw tube by the pressing operation of the knock member, and the moving body can advance to extrude the content with this rotation, so that the usability of the cartridge-type content extrusion container can be improved. That is, since the content can be extruded by holding the cartridge-type content extrusion container with one hand and pressing the knock member with one hand, so that the cartridge-type content extrusion container having high usability can be obtained. As described above, in this cartridge-type content extrusion container, the content can be extruded by knocking, so that the usability can be further improved.

The cartridge-type content extrusion container may have a first spring (or forward spring) that biases the moving body forward. In this case, when the cartridge unit is removed from the main body tube, the moving body can be moved forward by the first spring.

The cartridge-type content extrusion container may be provided between the screw tube and the rotating member and may have a second spring (or rearward spring) that moves the rotating member and the knock member backward when the pressing on the knock member is released. In this case, when the pressing on the knock member is released, the rotating member and the knock member can be moved backward by the second spring.

The cartridge-type content extrusion container may include a ratchet member provided between the rotating member and the knock member and having a plurality of third teeth aligned along the circumferential direction. The rotating member may have a plurality of fourth teeth that are aligned along the circumferential direction and engaged with the third teeth. When the pressing on the knock member is released, the rotating member moves backward to allow the fourth teeth to be engaged with the third teeth, and the rotating member and the moving body rotate with respect to the ratchet member, so that the screwing function may work to allow the moving body to advance. In this case, the moving body can be advanced to extrude the content not only when the knock member is pressed but also when the pressing on the knock member is released. Therefore, the usability of the cartridge-type content extrusion container can be further improved.

The cartridge-type content extrusion container may include a third spring (or release spring) that is provided between the screw adjusting member and the screw tube and advances the screw adjusting member when the cartridge unit is removed from the main body tube. In this case, when the cartridge unit is removed from the main body tube, by advancing the screw adjusting member by the third spring, the elastic portion can be expanded in the radial direction to easily release the screwing between the female screw and the male screw.

When the cartridge unit is attached to the main body tube, the screw adjusting member may be pushed by the cartridge unit to move backward and may narrow the elastic portion of the screw tube in the radial direction to screw the female screw into the male screw. In this case, since the screw adjusting member moves backward to screw the female screw into the male screw when the cartridge unit is attached, the screwing of the female screw with the male screw can be easily performed.

The cartridge unit may have an accommodation chamber accommodating the content and a piston provided in the accommodation chamber. The moving body may extrude the content through the piston. In this case, when the content is a liquid content, a leakage of the liquid content can be suppressed by the piston. Then, the liquid content can be extruded through the piston.

According to the present disclosure, usability can be further improved.

DETAILED DESCRIPTION

In the following description, with reference to the drawings, the same reference numbers are assigned to the same components or to similar components having the same function, and overlapping description is omitted.

Figure 1A:
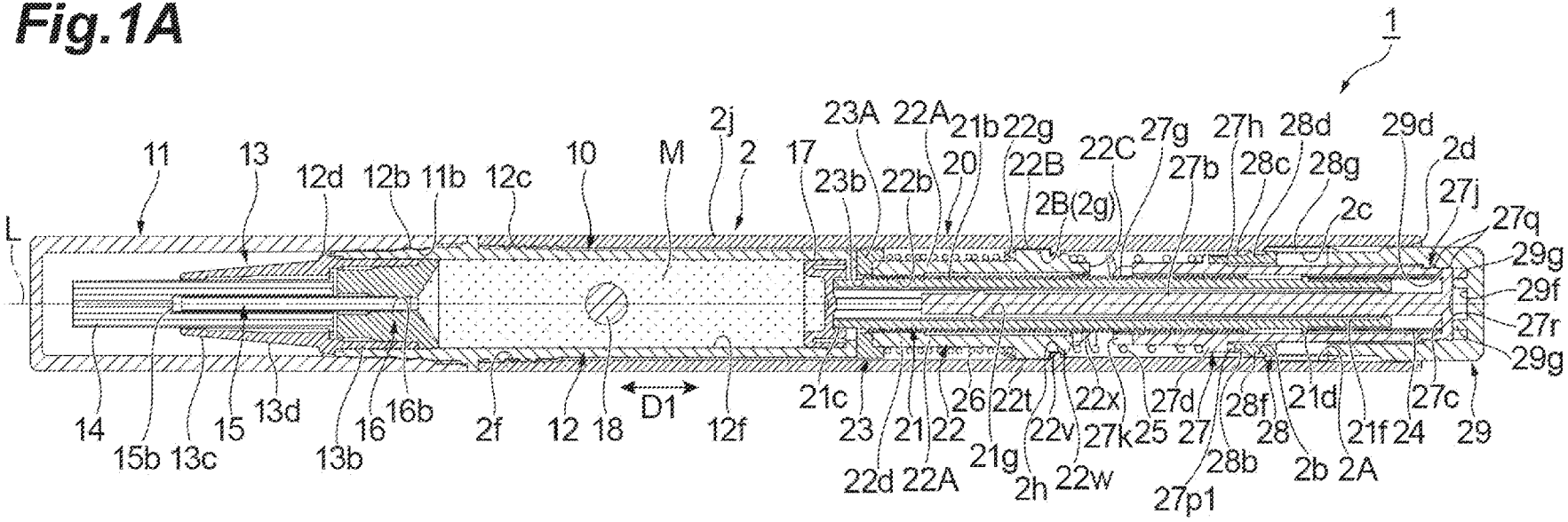
FIG. 1A is a cross-sectional view illustrating a cartridge-type content extrusion container according to an example, including a main body tube.
Figure 1B:
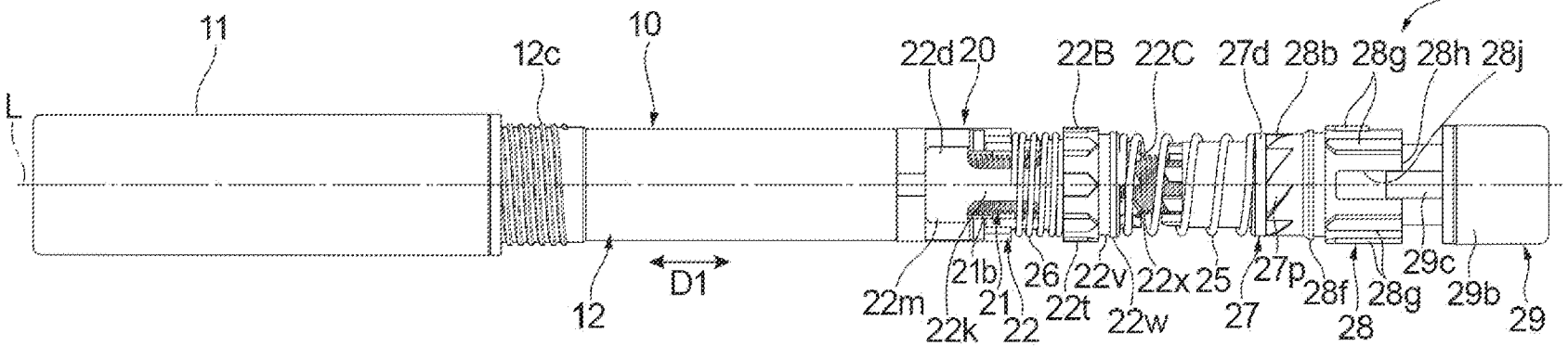
FIG. 1B is a side view illustrating a state in which the main body tube of the cartridge-type content extrusion container according to the example is removed.

FIG. 1A is a cross-sectional view of a cartridge-type content extrusion container 1 according to an example. FIG. 1B is a side view illustrating a state in which a main body tube 2 of the cartridge-type content extrusion container 1 is removed. As illustrated in FIGS. 1A and 1B, the cartridge-type content extrusion container 1 is a container that extrudes a content (e.g., a material) M contained inside by a knock operation of a user. The content M is, for example, a liquid content.

As an example, the content M is a liquid cosmetic material. In this case, the content M is an eyeliner or a lip liner. The cartridge-type content extrusion container 1 is a container used when the content M is coated to a to-be coated portion such as skin. The cartridge-type content extrusion container 1 exhibits a round bar shape (stick shape).

The cartridge-type content extrusion container 1 extends along an axial direction D1 in which an axial line L of the cartridge-type content extrusion container 1 extends. The cartridge-type content extrusion container 1 includes a cartridge unit (e.g., a cartridge) 10 containing the content M and a knock mechanism unit 20 for extruding the content M contained in the cartridge unit 10.

The cartridge unit 10 is removably attached (e.g., attachable to and detachable from) the knock mechanism unit 20. The cartridge unit 10 can be removed from the knock mechanism unit 20, for example, after the content M has been used up. Further, a new cartridge unit 10 can be attached to the knock mechanism unit 20. In the present disclosure, as viewed from the knock mechanism unit 20, the direction in which the cartridge unit 10 is provided and the direction in which the content M is urged to be extruded are described as "front", "front side", or "forward", and the direction in which the knock mechanism unit 20 is provided as viewed from the cartridge unit 10 is described as "rear", "rear side", or "backward".

First, the cartridge unit 10 will be described. The cartridge unit 10 has a cap 11, a cartridge tube 12 to which the cap 11 is attached, a sleeve 13 attached to a front side of the cartridge tube 12, and a coating body 14 provided inside the sleeve 13 and protruding forward from the sleeve 13. Further, the cartridge unit 10 has a pipe material 15 inserted into the coating body 14 and a pipe holder 16 that holds the pipe material 15 on the rear side of the pipe material 15.

The cap 11 exhibits a bottomed cylinder shape. The cap 11 may be made of polypropylene (PP), for example. The cap 11 has an annular convex portion 11*b* on the inner surface, and the cartridge tube 12 has a convex portion 12*b* on the outer surface with which the annular convex portion 11*b* is engaged in the axial direction D1. The cartridge tube 12 protrudes backward from the cap 11 in a state where the convex portion 12*b* is engaged with the annular convex portion 11*b* of the cap 11 in the axial direction D1.

The cartridge tube 12 may be made of PP, for example. The cartridge tube 12 defines an accommodation chamber 12*f* in which the content M is accommodated. The cartridge unit 10 has a piston 17 located on the rear side of the accommodation chamber 12*f*. The piston 17 may be formed of an elastic body. The space in front of the piston 17 inside the cartridge tube 12 is set as the accommodation chamber 12*f*. The piston 17 is for extruding the content M and is slidable in the accommodation chamber 12*f*.

The cartridge tube 12 has a male screw portion 12*c*. The cartridge unit 10 is attached to the knock mechanism unit 20 by screwing the male screw portion 12*c* into the main body tube 2. It is noted that the structure of attaching the cartridge unit 10 to the knock mechanism unit 20 is not limited to the above-mentioned screwing. For example, instead of the above-mentioned screwing, there may be a structure in which a protrusion may be provided on the inner surface of each of the cartridge unit 10 and the knock mechanism unit 20, and the protrusion of the cartridge unit 10 may be engaged with the protrusion of the knock mechanism unit 20.

The sleeve 13 may be made of PP, for example. The sleeve 13 has an insertion portion 13*b* inserted into an opening 12*d* located at the front end of the cartridge tube 12 and a distal end portion 13*c* located on a front side of the insertion portion 13*b*. The insertion portion 13*b* exhibits a tubular shape, and the pipe holder 16 is inserted inside the insertion portion 13*b*. The distal end portion 13*c* is a portion exposed to the outside when the cartridge-type content extrusion container 1 is used. The distal end portion 13*c* has a tapered surface 13*d* that is inclined so as to decrease in diameter toward the front side.

The coating body 14 may be made of polybutylene terephthalate (PBT), for example. The coating body 14 is, for example, a writing brush. The coating body 14 is attached to the sleeve 13 in a state of surrounding the front portion of the pipe material 15. The coating body 14 is bundled inside the sleeve 13, and the front portion of the coating body 14 protrudes forward from the sleeve 13. The content M is supplied to the coating body 14 from the accommodation chamber 12*f* through the pipe material 15.

The pipe material 15 may be made of steel use stainless (SUS), for example. The pipe material 15 extends in the axial direction D1 inside the coating body 14 and inside the pipe holder 16. The pipe material 15 has an opening 15*b* located on the front side, and the opening 15*b* is an opening for supplying the content M extruded by the piston 17 to the coating body 14.

The pipe holder 16 may be made of PP, for example. The pipe holder 16 is engaged with the cartridge tube 12 in the axial direction D1 inside the cartridge tube 12. The pipe holder 16 has a through-hole 16*b* penetrating the pipe holder 16 in the axial direction D1, and the pipe material 15 is inserted into the through-hole 16*b*. The through-hole 16*b* communicates with the accommodation chamber 12*f*, and the content M of the accommodation chamber 12*f* is supplied to the coating body 14 through the pipe material 15 inserted into the through-hole 16*b*.

The cartridge unit 10 has, for example, an agitator 18 that stirs the content M. The agitator 18 together with the content M is accommodated in the accommodation chamber 12*f* of the cartridge tube 12. The agitator 18 is may be made of SUS, for example. The agitator 18 exhibits a spherical shape. When the cartridge-type content extrusion container 1 is moved by the user, the agitator 18 moves in the accommodation chamber 12*f* to stir the content M.

Next, the knock mechanism unit 20 will be described. The knock mechanism unit 20 includes, for example, the main body tube 2, a moving body 21, a screw tube 22, a screw adjusting member (or screw locking member) 23, a first spring (or forward spring) 24, a second spring (or rearward spring) 25, a third spring (or release spring) 26, a rotating member 27, a ratchet member 28, and a knock member (or knock actuator) 29.

Figure 2A:
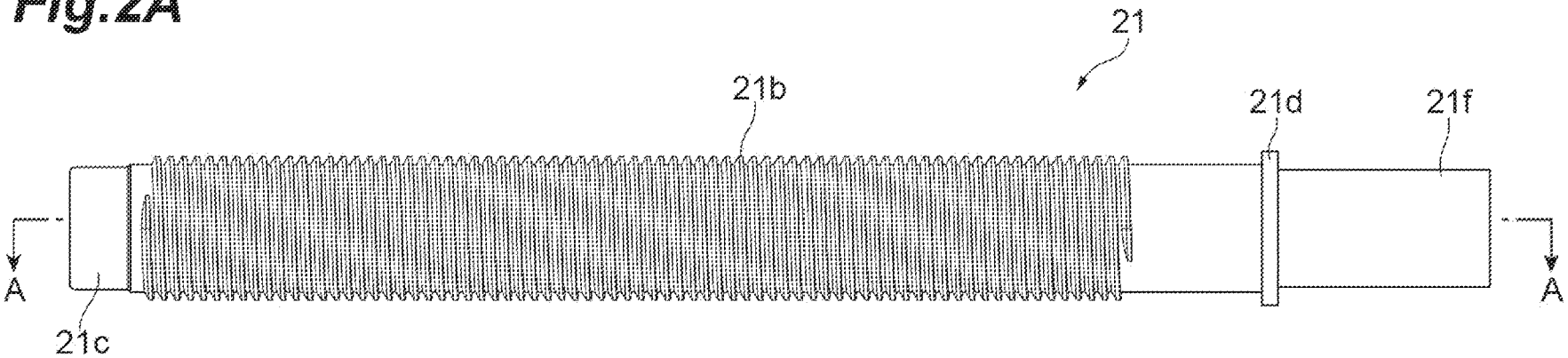
FIG. 2A is a side view illustrating a moving body of the cartridge-type content extrusion container of FIG. 1A.
Figure 2B:
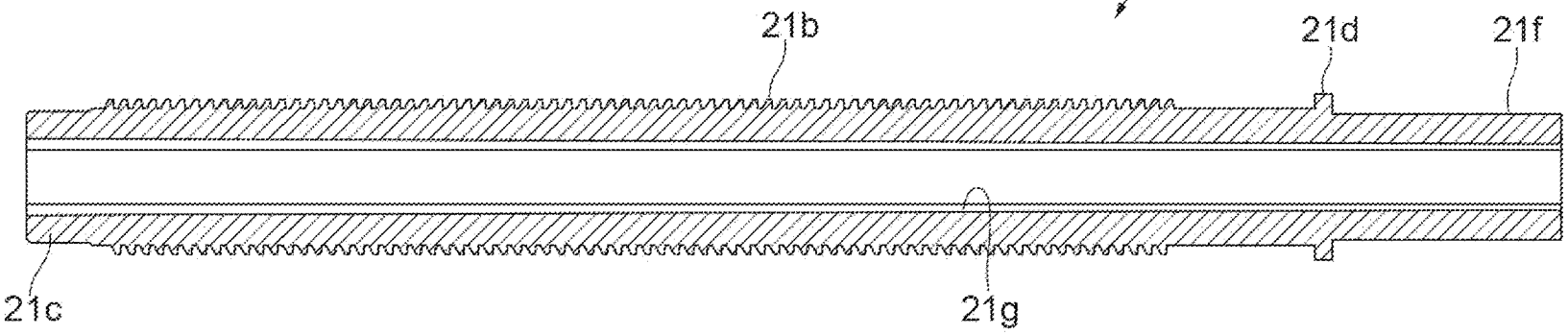
FIG. 2B is a cross-sectional view taken along a line A-A of FIG. 2A.

FIG. 2A is a side view illustrating the moving body 21. FIG. 2B is a cross-sectional view taken along a line A-A of FIG. 2A. As illustrated in FIGS. 1A, 1B, 2A, and 2B, the moving body 21 exhibits a tubular shape. The moving body 21 may be made of PBT or polyacetal (POM), for example. The moving body 21 is coupled with the piston 17 to push the piston 17 forward, so as to extrude the content M. The moving body 21 has a male screw (or male screw thread) 21*b* formed on the outer periphery, a pressing portion 21*c* pushing the piston 17 in front of the male screw 21*b*, a flange portion 21*d* located behind the male screw 21*b*, and a tubular portion 21*f* extending backward from the flange portion 21*d*.

The male screw 21*b* extends along the axial direction D1 in the region including the center of the axial direction D1 of the moving body 21. The pressing portion 21*c* is located in front of the male screw 21*b* and presses the piston 17 from the rear as the moving body 21 advances. The flange portion 21*d* has an enlarged diameter behind the male screw 21*b*. The first spring 24 abuts on the surface of the flange portion 21*d* facing the rear side. The tubular portion 21*f* is a portion that is inserted into the inside of the first spring 24.

The moving body 21 is inserted inside the screw tube 22, the screw adjusting member 23, the first spring 24, the second spring 25, the third spring 26, and the rotating member 27. Further, the moving body 21 has a tubular hole 21*g* into which a bar-shaped portion 27*b* of the rotating member 27 is inserted, and the tubular hole 21*g* penetrates the moving body 21 in the axial direction D1. The cross-sectional shape when the tubular hole 21*g* is cut in a plane perpendicular to the axial direction D1 is a non-circular shape (a square shape as an example).

Figure 3A:
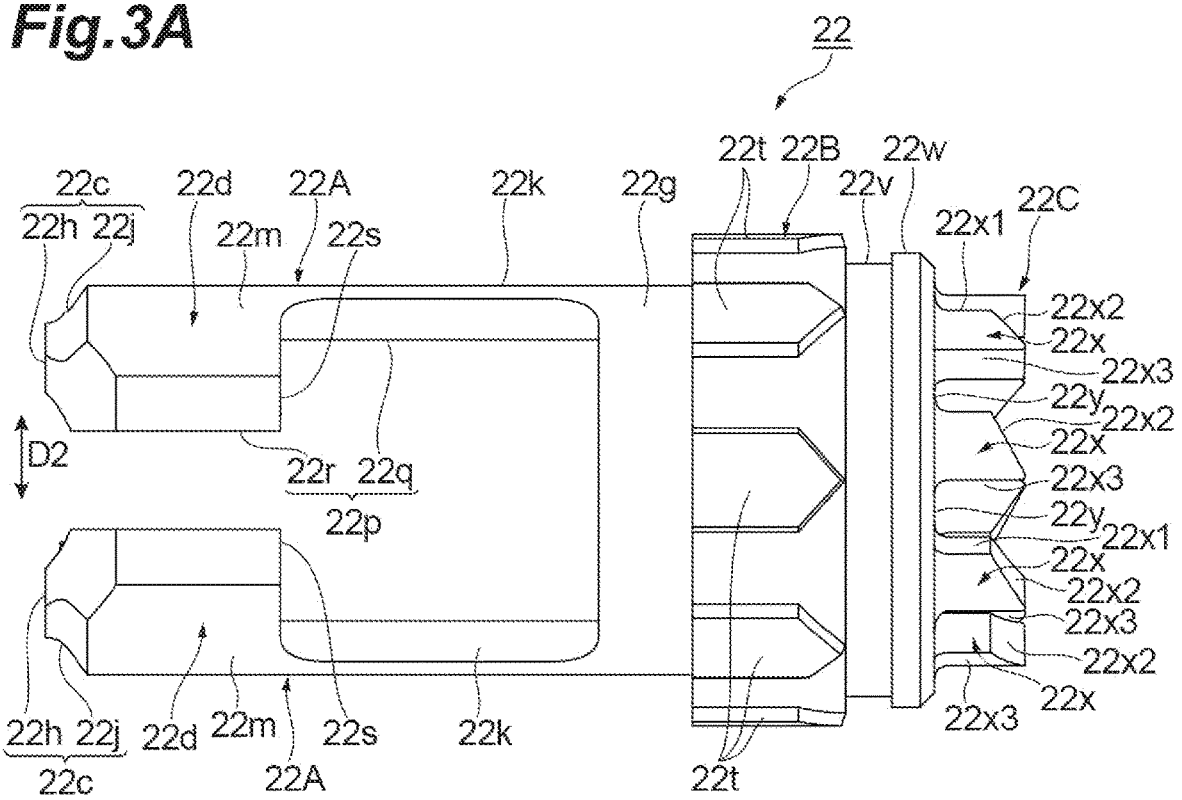
FIG. 3A is a side view illustrating a screw tube of the cartridge-type content extrusion container of FIG. 1A.
Figure 3B:
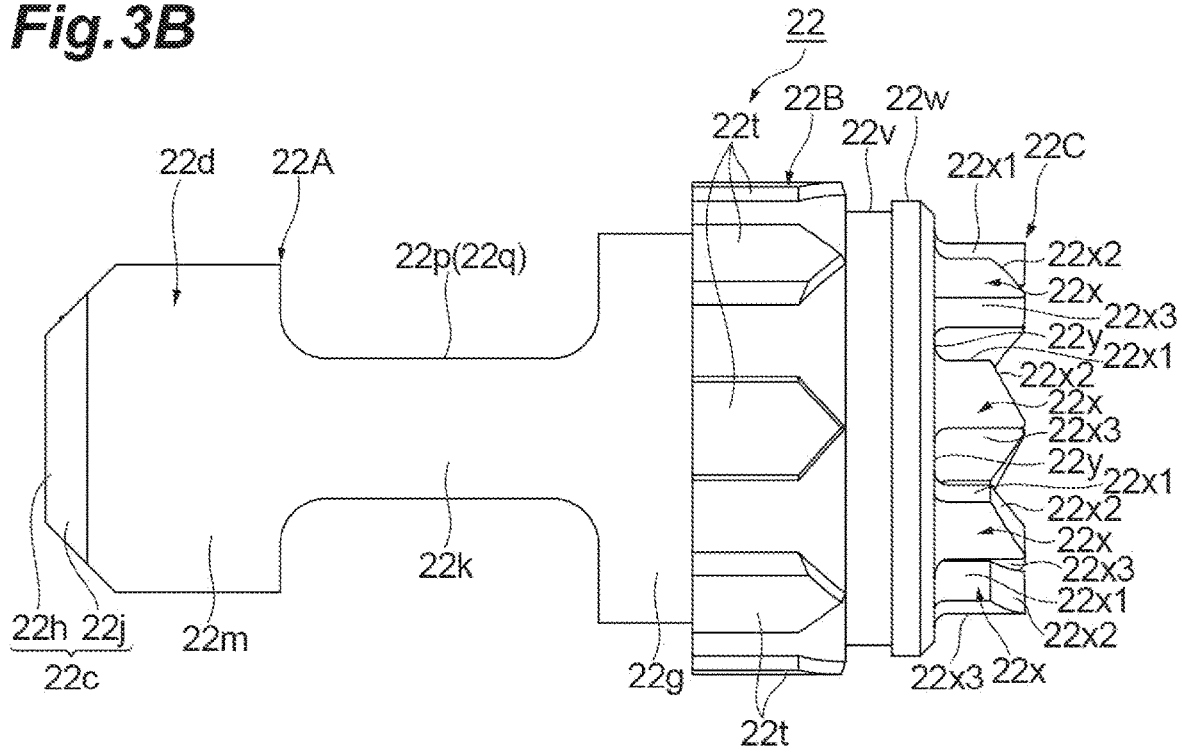
FIG. 3B is a side view of the screw tube viewed from a direction different from that of FIG. 3A.
Figure 4:
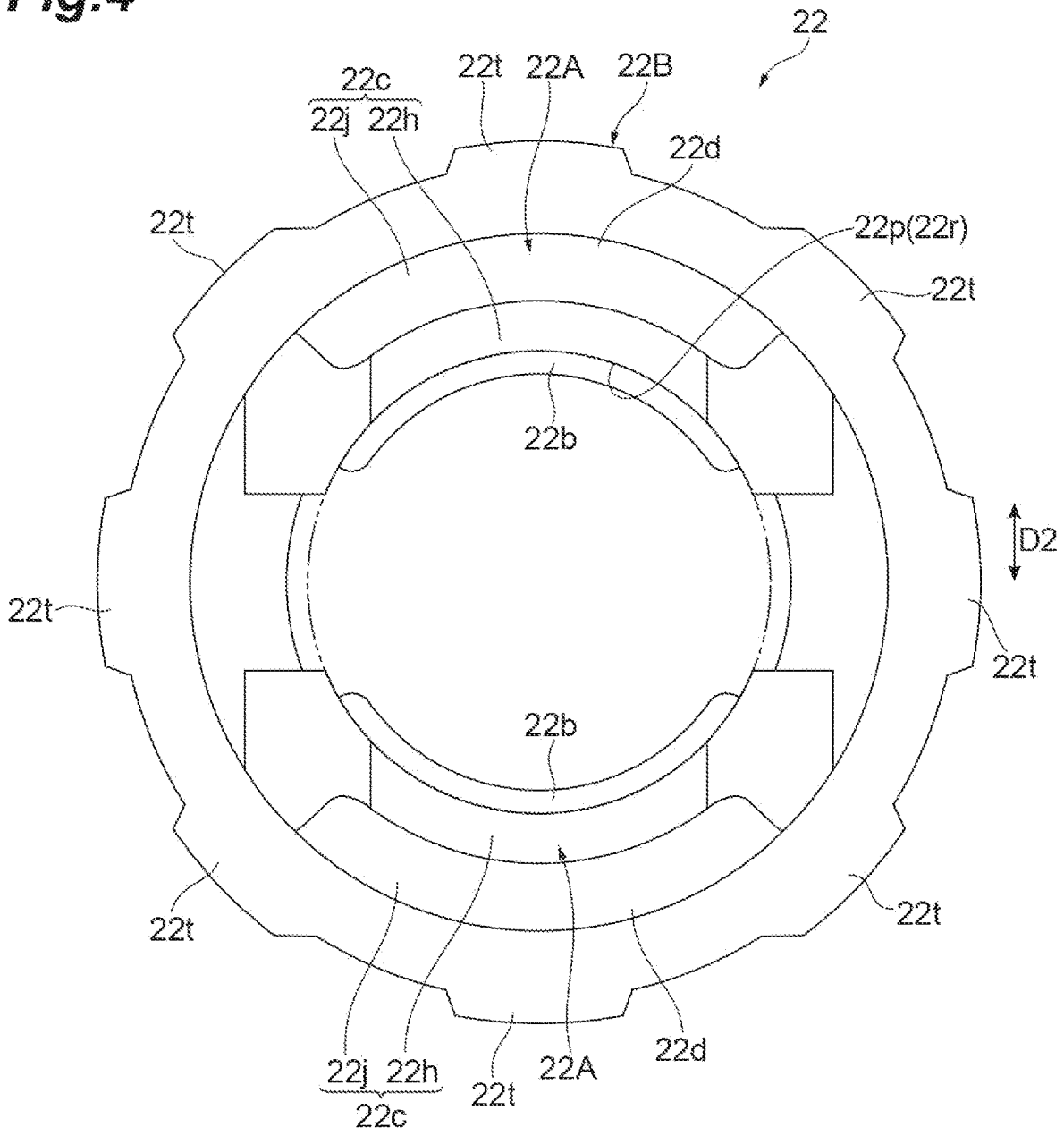
FIG. 4 is a front view illustrating the screw tube of FIG. 3A.

FIG. 3A is a side view illustrating the screw tube 22. FIG. 3B is a side view illustrating the screw tube 22 as viewed from a direction different from that of FIG. 3A. FIG. 4 is a front view of the screw tube 22 when the screw tube 22 is viewed from the front. As illustrated in FIGS. 1A, 1B, 3A, 3B, and 4, the screw tube 22 has an arm portion 22A on which a female screw (or female screw thread) 22*b* screwed with the male screw 21*b* of the moving body 21 is formed, a first engaging portion 22B engaged with the main body tube 2 on the rear side of the arm portion 22A, and a second engaging portion 22C engaged with the rotating member 27 behind the first engaging portion 22B. The female screw thread 22*b* and the male screw thread 21*b* form a screw coupling to operatively engage the moving body 21 with the screw tube 22.

The screw tube 22 may be made of PBT, for example. The screw tube 22 has, for example, a pair of the arm portions 22A aligned along a radial direction D2 of the screw tube 22. The arm portion 22A has the female screw 22*b* formed on the inner peripheral surface of the arm portion 22A facing inward in the radial direction D2, an abutting portion 22*c* on which the screw adjusting member 23 abuts, an elastic portion 22*d* elastically deformed along the radial direction D2 and a base portion 22*g* interposed between the elastic portion 22*d* and the first engaging portion 22B.

The abutting portion 22*c* has a front end face 22*h* constituting the front end of the screw tube 22 and an inclined surface 22*j* extending on the outer side and the rear side in the radial direction D2 from the front end face 22*h*. The inclined surface 22*j* is, for example, a curved surface that curves on the outer side and the rear side in the radial direction D2. When the screw adjusting member 23 moves backward with the attaching of the cartridge unit 10 to the main body tube 2, a portion of the screw adjusting member 23 rides over the inclined surface 22*j* to be located outside the elastic portion 22*d* in the radial direction D2.

The elastic portion 22*d* has a narrow portion 22*k* extending forward from the base portion 22*g* and a wide portion 22*m* extending in the circumferential direction of the screw tube 22 from the front end of the narrow portion 22*k*. The wide portion 22*m* is provided between the abutting portion 22*c* and the narrow portion 22*k*. A concave portion 22*p* into which a portion of the screw adjusting member 23 is inserted is formed between the pair of elastic portions 22*d* aligned along the radial direction D2.

The concave portion 22*p* includes a first concave portion 22*q* located between a pair of the narrow portions 22*k* aligned along the radial direction D2 and a second concave portion 22*r* located between a pair of the wide portions 22*m* aligned along the radial direction D2. The length of the first concave portion 22*q* in the circumferential direction of the screw tube 22 is greater than the length of the second concave portion 22*r* in the circumferential direction of the screw tube 22.

In a state where the cartridge unit 10 is attached to the main body tube 2, a portion of the screw adjusting member 23 is inserted into the concave portion 22*p*. An abutting portion 22*s* on which a portion of the screw adjusting member 23 abuts is formed between the first concave portion 22*q* and the second concave portion 22*r*. When the cartridge unit 10 is removed from the main body tube 2, the screw adjusting member 23 advances, and the advancing screw adjusting member 23 abuts on the abutting portion 22*s*, so that the elastic portion 22*d* (wide portion 22*m*) is expanded in the radial direction D2.

The first engaging portion 22B has a plurality of convex portions 22*t* formed so as to be aligned along the circumferential direction on the outer peripheral surface of the screw tube 22, an annular concave portion 22*v* located behind the convex portion 22*t*, and an annular convex portion 22*w* located behind the annular concave portion 22*v*. The convex portion 22*t* is engaged with the inner surface of the main body tube 2 in the rotational direction, and the annular concave portion 22*v* and the annular convex portion 22*w* are engaged with the inner surface of the main body tube 2 in the axial direction D1. Therefore, the screw tube 22 is engaged with the main body tube 2 so as to be movable in the rotational direction and immovable in the axial direction.

The second engaging portion 22C has a plurality of first teeth 22*x* aligned along the circumferential direction of the screw tube 22 and concave portions 22*y* located between respective pairs of the first teeth 22*x* that are adjacent to each other along the circumferential direction. As an example, the second engaging portion 22C has eight first teeth 22*x* and eight concave portions 22*y*. The first teeth 22*x* are provided so as to rotate the rotating member 27 with respect to the screw tube 22.

Each of first teeth 22*x* has a first surface 22*x*1 extending in the axial direction D1, an inclined surface 22*x*2 extending backward from the rear end of the first surface 22*x*1 and on one side of the screw tube 22 in the circumferential direction, and a second surface 22*x*3 extending forward from the rear end of the inclined surface 22*x*2. The length of the second surface 22*x*3 in the axial direction D1 is greater than the length of the first surface 22*x*1 in the axial direction D1.

Figure 5A:
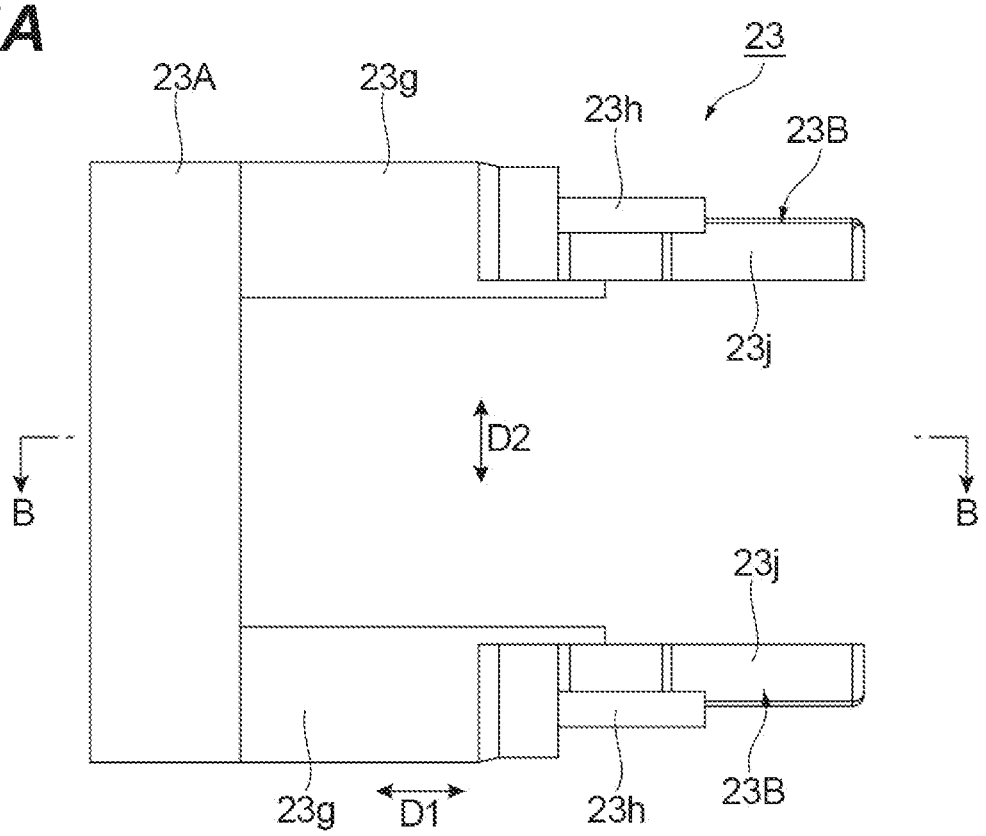
FIG. 5A is a side view illustrating a screw adjusting member of the cartridge-type content extrusion container of FIG. 1A.
Figure 5B:
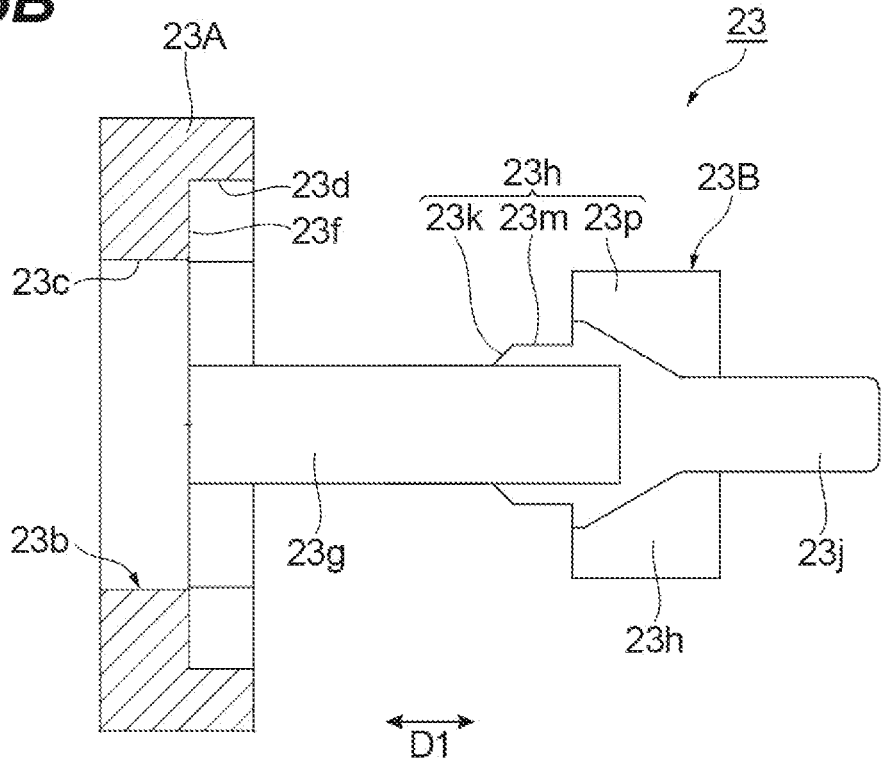
FIG. 5B is a cross-sectional view taken along line B-B of FIG. 5A.
Figure 6:
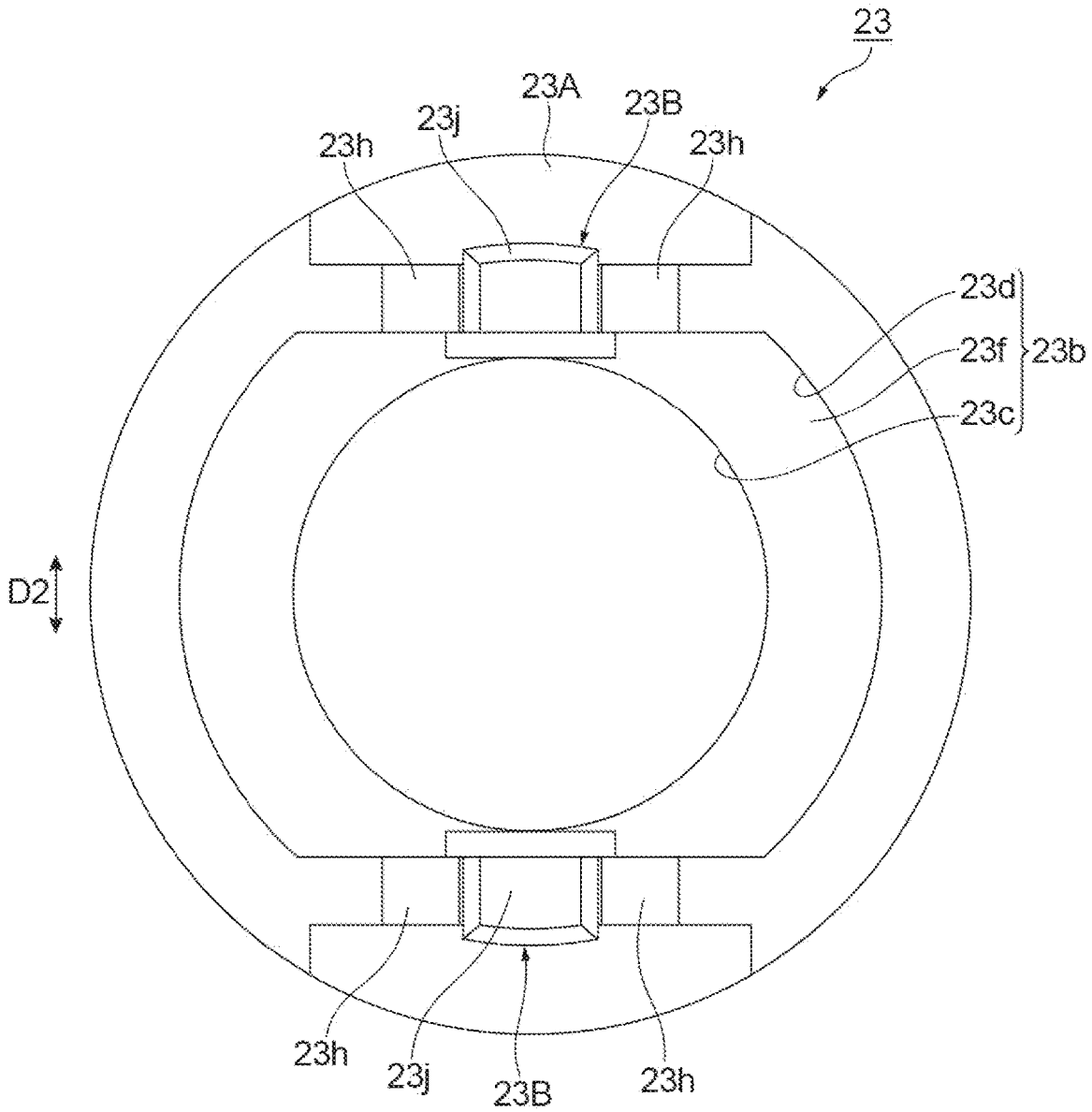
FIG. 6 is a rear view of the screw adjusting member of FIG. 5A as viewed from a rear.

FIG. 5A is a side view illustrating the screw adjusting member 23. FIG. 5B is a cross-sectional view taken along a line B-B of FIG. 5A. FIG. 6 is a rear view of the screw adjusting member 23 as viewed from the rear. As illustrated in FIGS. 1A, 1B, 5A, 5B, and 6, the screw adjusting member 23 has an annular portion 23A facing the front side and an arm portion 23B extending backward from the annular portion 23A. The screw adjusting member 23 adjusts the screwing of the female screw 22*b* of the screw tube 22 with the male screw 21*b* of the moving body 21. The screw adjusting member 23 may be made of PBT, for example.

The annular portion 23A is a portion which rides on the screw tube 22 to reduce the diameter of the screw tube 22 and screws the female screw 22*b* with the male screw 21*b* when the screw adjusting member 23 moves backward. For example, the annular portion 23A accommodates the elastic portion 22*d* of the screw tube 22 to limit the deformation of the elastic portion 22*d* in the radial direction. The annular portion 23A has a through-hole 23*b* penetrating in the axial direction D1. The through-hole 23*b* is defined by a first inner peripheral surface 23*c*, a second inner peripheral surface 23*d* having an inner diameter greater than that of the first inner peripheral surface 23*c*, and a rear surface 23*f* extending along the radial direction of the annular portion 23A from a front end of the second inner peripheral surface 23*d* to the rear end of the first inner peripheral surface 23*c*. The second inner peripheral surface 23*d* is located behind the first inner peripheral surface 23*c*.

The screw adjusting member 23 has a pair of the arm portions 23B aligned along the radial direction D2. The arm portion 23B moves along the axial direction D1 in a state of being inserted into the concave portion 22*p* (refer to FIG. 3A) of the screw tube 22. The arm portion 23B is a portion that expands the diameter of the elastic portion 22*d* when the screw adjusting member 23 advances to release the screwing of the female screw 22*b* with the male screw 21*b*.

The arm portion 23B has a base portion 23*g* extending backward from the annular portion 23A, a projecting portion 23*h* projecting on both sides in the circumferential direction of the annular portion 23A, at the rear end of the base portion 23*g*, and an extending portion 23*j* extending backward from the projecting portion 23*h*. The projecting portion 23*h* has an inclined surface 23*k* that is inclined so as to spread in the circumferential direction of the annular portion 23A from the base portion 23*g*, an extending portion 23*m* extending backward from the inclined surface 23*k*, and a blade portion 23*p* protruding in the circumferential direction of the annular portion 23A behind the extending portion 23*m*.

As illustrated in FIG. 1A, the first spring 24 is accommodated inside the rotating member 27. The first spring 24 is arranged between a bottom surface 27*c* of the rotating member 27 exhibiting a bottomed tubular shape and a flange portion 21*d* of the moving body 21 and is expandable and contractible in the axial direction D1. The first spring 24 biases the moving body 21 forward inside the rotating member 27.

The second spring 25 is arranged between the annular convex portion 22*w* of the screw tube 22 and a flange portion 27*d* of the rotating member 27 and is expandable and contractible in the axial direction D1. The second spring 25 biases the rotating member 27 backward with respect to the screw tube 22. The third spring 26 is arranged between the annular portion 23A of the screw adjusting member 23 and the convex portion 22*t* of the screw tube 22 and is expandable and contractible in the axial direction D1. The third spring 26 biases the screw adjusting member 23 forward with respect to the screw tube 22. Each of the first spring 24, the second spring 25, and the third spring 26 may be made of SUS, for example.

Figure 7A:
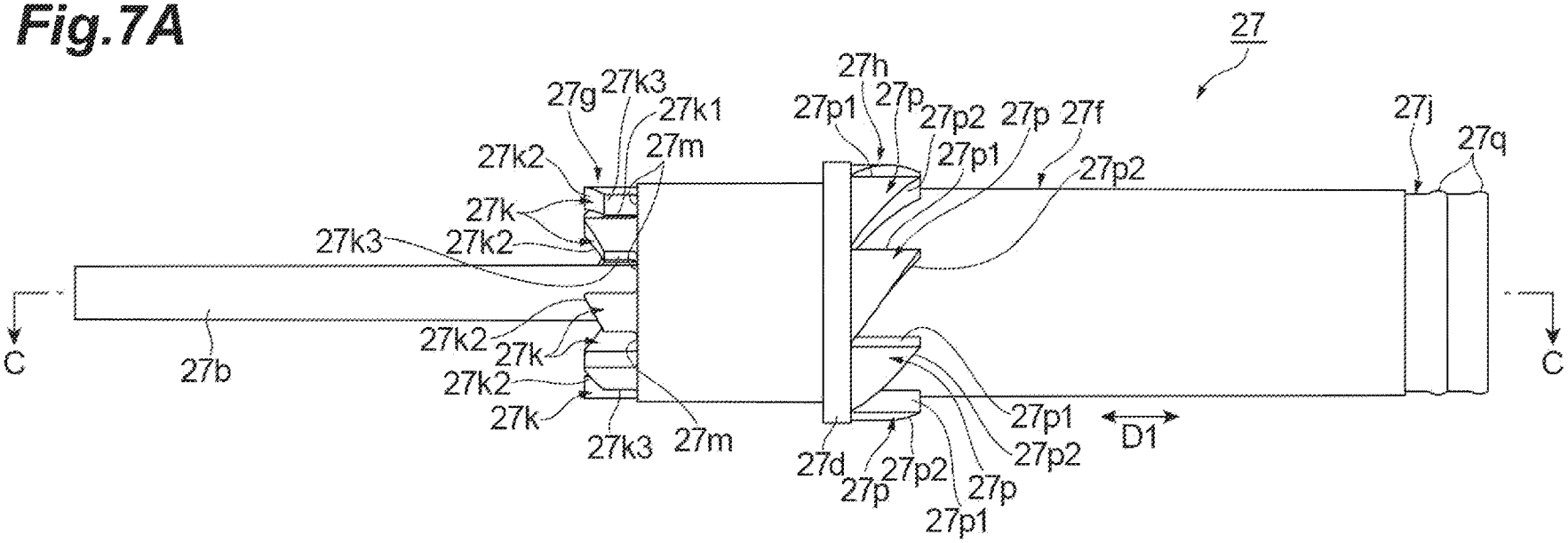
FIG. 7A is a side view illustrating a rotating member of the cartridge-type content extrusion container of FIG. 1A.
Figure 7B:
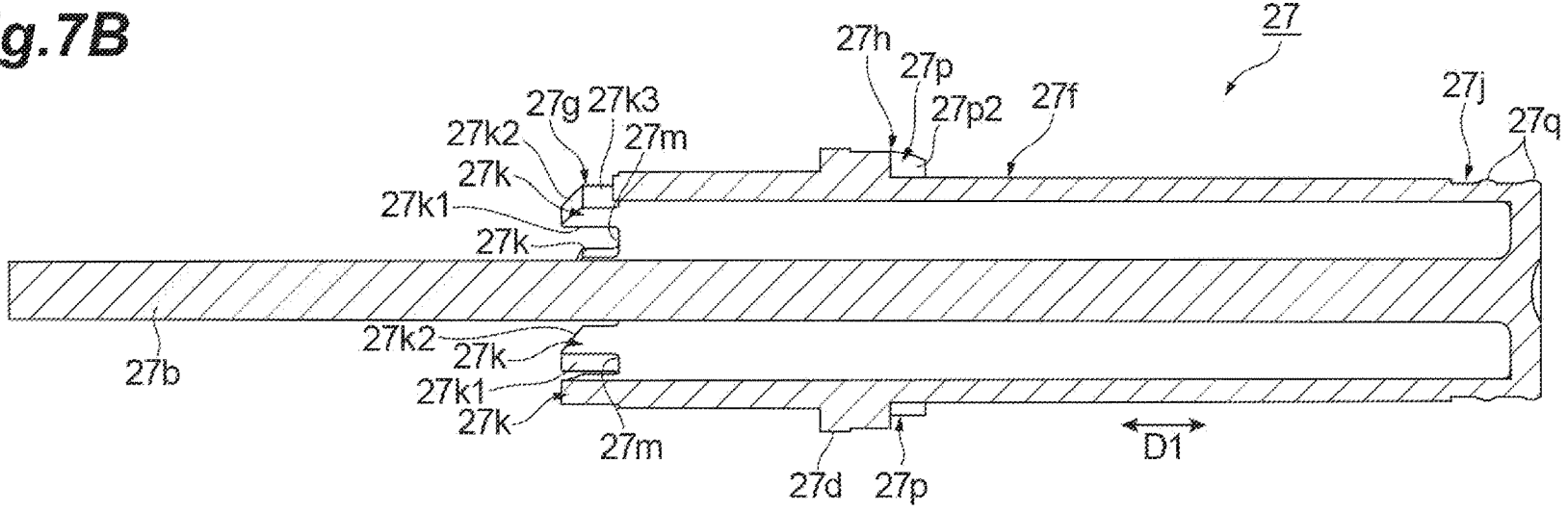
FIG. 7B is a cross-sectional view taken along a line C-C of FIG. 7A.
Figure 8:
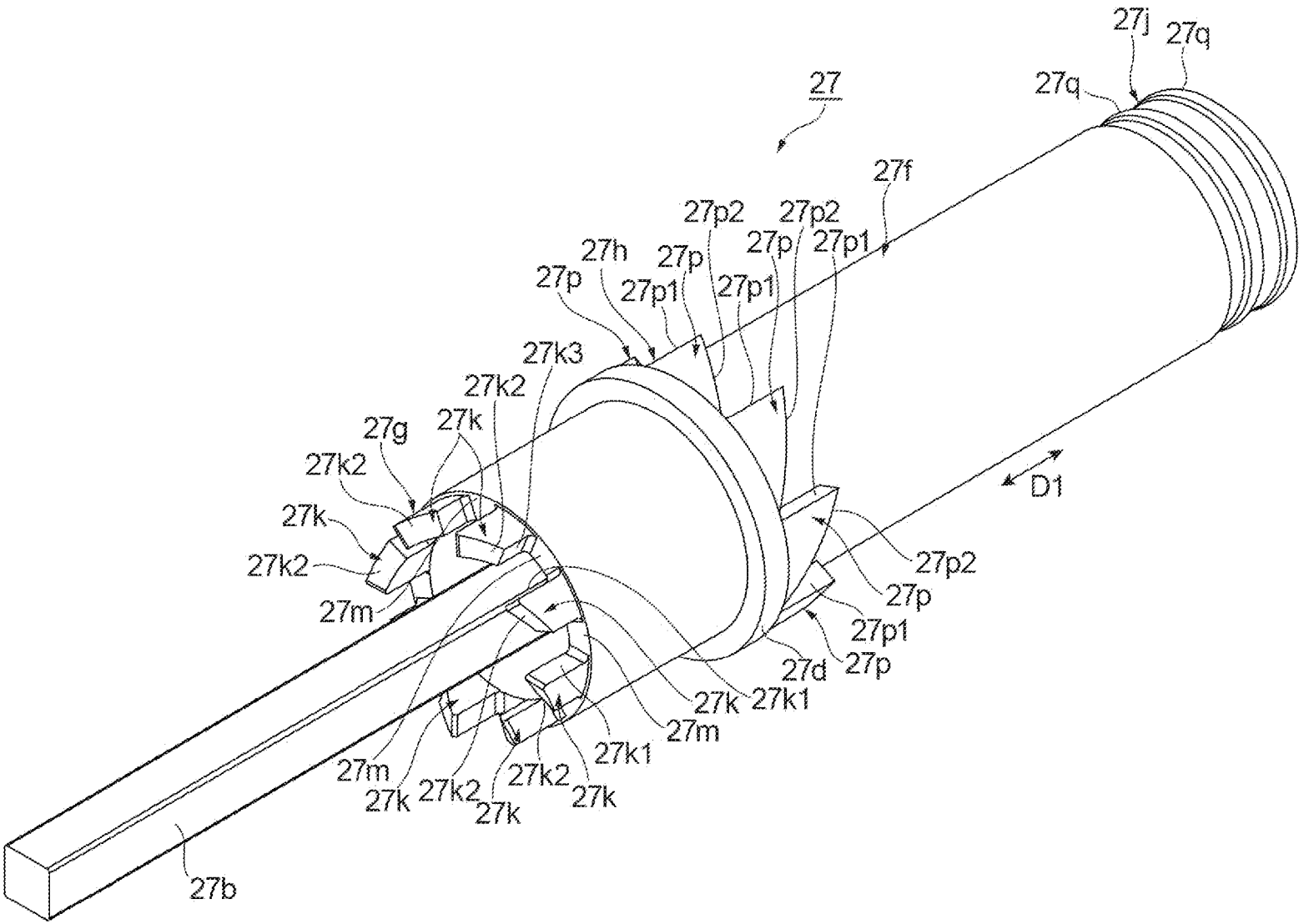
FIG. 8 is a perspective view illustrating the rotating member of FIG. 7A.

FIG. 7A is a side view illustrating the rotating member 27. FIG. 7B is a cross-sectional view taken along a line C-C of FIG. 7A. FIG. 8 is a perspective view illustrating the rotating member 27. As illustrated in FIGS. 1A, 1B, 7A, 7B, and 8, the rotating member 27 exhibits a bottomed cylindrical shape. The rotating member 27 has a bar-shaped portion 27*b* that protrudes forward in the rotating member 27 and a tubular portion 27*f* that includes the bottom surface 27*c*. The rotating member 27 may be made of PBT or POM, for example.

The cross-sectional shape when the bar-shaped portion 27*b* is cut in a cross section perpendicular to the axial direction D1 is a non-circular shape (square shape as an example). The bar-shaped portion 27*b* is engaged with the tubular hole 21*g* of the moving body 21 in the rotational direction. As a result, the moving body 21 is rotatable synchronously with the rotating member 27.

The tubular portion 27*f* has a first engaging portion 27*g* engaged with the screw tube 22, a second engaging portion 27*h* engaged with the ratchet member 28, and a third engaging portion 27*j* engaged with the knock member 29. The first engaging portion 27*g*, the second engaging portion 27*h*, and the third engaging portion 27*j* are aligned in this order along the axial direction D1.

The first engaging portion 27*g* is located at the front end of the tubular portion 27*f*. The first engaging portion 27*g* has a plurality of second teeth 27*k* aligned along the circumferential direction of the rotating member 27 and concave portions 27*m* located between respective pairs of the second teeth 27*k* that are adjacent to each other along the circumferential direction. As an example, the first engaging portion 27*g* has eight second teeth 27*k* and eight concave portions 27*m*. The second teeth 27*k* are provided so as to rotate the rotating member 27 with respect to the screw tube 22.

Each of the second teeth 27*k* has a third surface 27*k*1 extending in the axial direction D1, an inclined surface 27*k*2 extending backward from the front end of the third surface 27*k*1 and extending to one side of the rotating member 27 in the circumferential direction, and a fourth surface 27*k*3 extending from the rear end of the inclined surface 27*k*2 backward. A length of the fourth surface 27*k*3 in the axial direction D1 is less than a length of the third surface 27*k*1 in the axial direction D1.

For example, the inclination angle of the inclined surface 27*k*2 with respect to the axial direction D1 is the same as the inclination angle of the inclined surface 22*x*2 (refer to FIGS. 3A and 3B) with respect to the axial direction D1. The rotating member 27 is movable in the axial direction D1 with respect to the screw tube 22. When the rotating member 27 advances, each of the second teeth 27*k* is engaged with a corresponding one of the first teeth 22*x*, the inclined surface 27*k*2 abuts on the inclined surface 22*x*2, and the rotating member 27 rotates at a certain angle (450 as an example) with respect to the screw tube 22 with this abutting. Accordingly, the second teeth 27*k* are engaged with the first teeth 22*x* to convert an axial movement of the rotating member 27 into a rotational movement of the rotating member 27. Since the moving body 21 is rotatable synchronously with the rotating member 27 relative to the screw tube 22 as described above, the rotational movement of the rotating member 27 causes the moving body 21 to rotate relative to the screw tube 22.

The second engaging portion 27*h* is located on the rear side of the flange portion 27*d*. The second engaging portion 27*h* has a plurality of fourth teeth 27*p* engaged with third teeth 28*b* of the ratchet member 28 described later. As an example, the second engaging portion 27*h* has eight fourth teeth 27*p*. Each of the fourth teeth 27*p* has a fifth surface 27*p*1 extending in the axial direction D1 and an inclined surface 27*p*2 extending forward from the rear end of the fifth surface 27*p*1 and one side of the rotating member 27 in the circumferential direction.

For example, the length of the fourth tooth 27*p* of the rotating member 27 in the circumferential direction is twice the length of the second tooth 27*k* of the rotating member 27 in the circumferential direction. Further, the position of the front end (the root side end) of the inclined surface 27*p*2 on the fourth tooth 27*p* coincides with the position of the front end of the fifth surface 27*p*1 on the other adjacent second teeth 27*k*. That is, the fourth tooth 27*p* is continuously formed along the circumferential direction of the rotating member 27.

The third engaging portion 27*j* is located at the rear end of the rotating member 27. The third engaging portion 27*j* has a plurality of annular concave portions 27*q* aligned along the axial direction D1. The annular concave portion 27*q* is engaged with the inner surface of the knock member 29 in the axial direction D1. As a result, the rotating member 27 is engaged with the knock member 29 in the axial direction D1 and is rotatably engaged with the knock member 29.

Figure 9A:
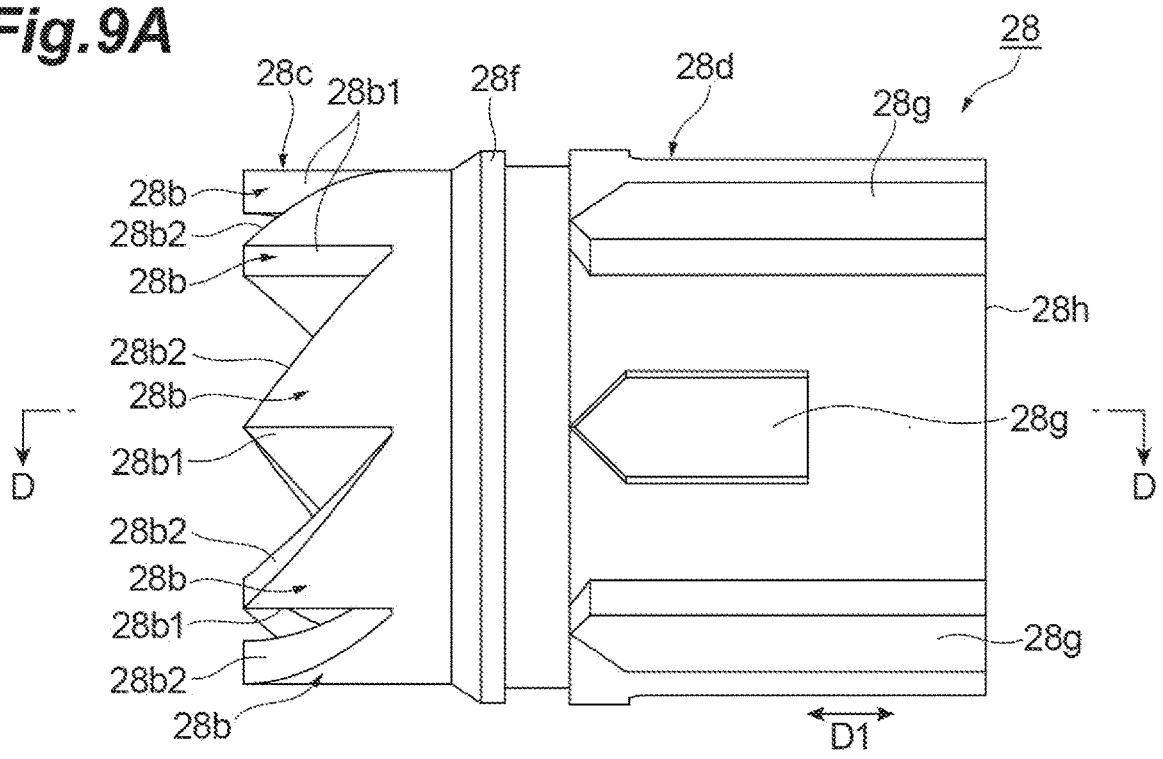
FIG. 9A is a side view illustrating a ratchet member of the cartridge-type content extrusion container of FIG. 1A.
Figure 9B:
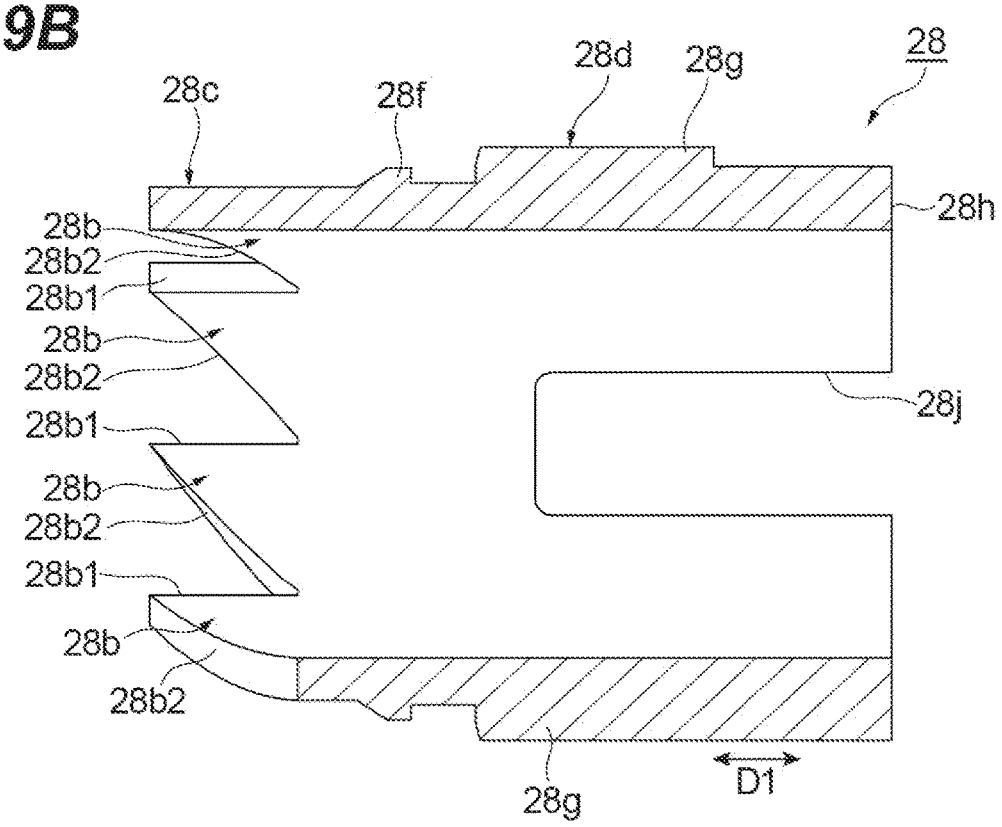
FIG. 9B is a cross-sectional view taken along a line D-D of FIG. 9A.
Figure 10:
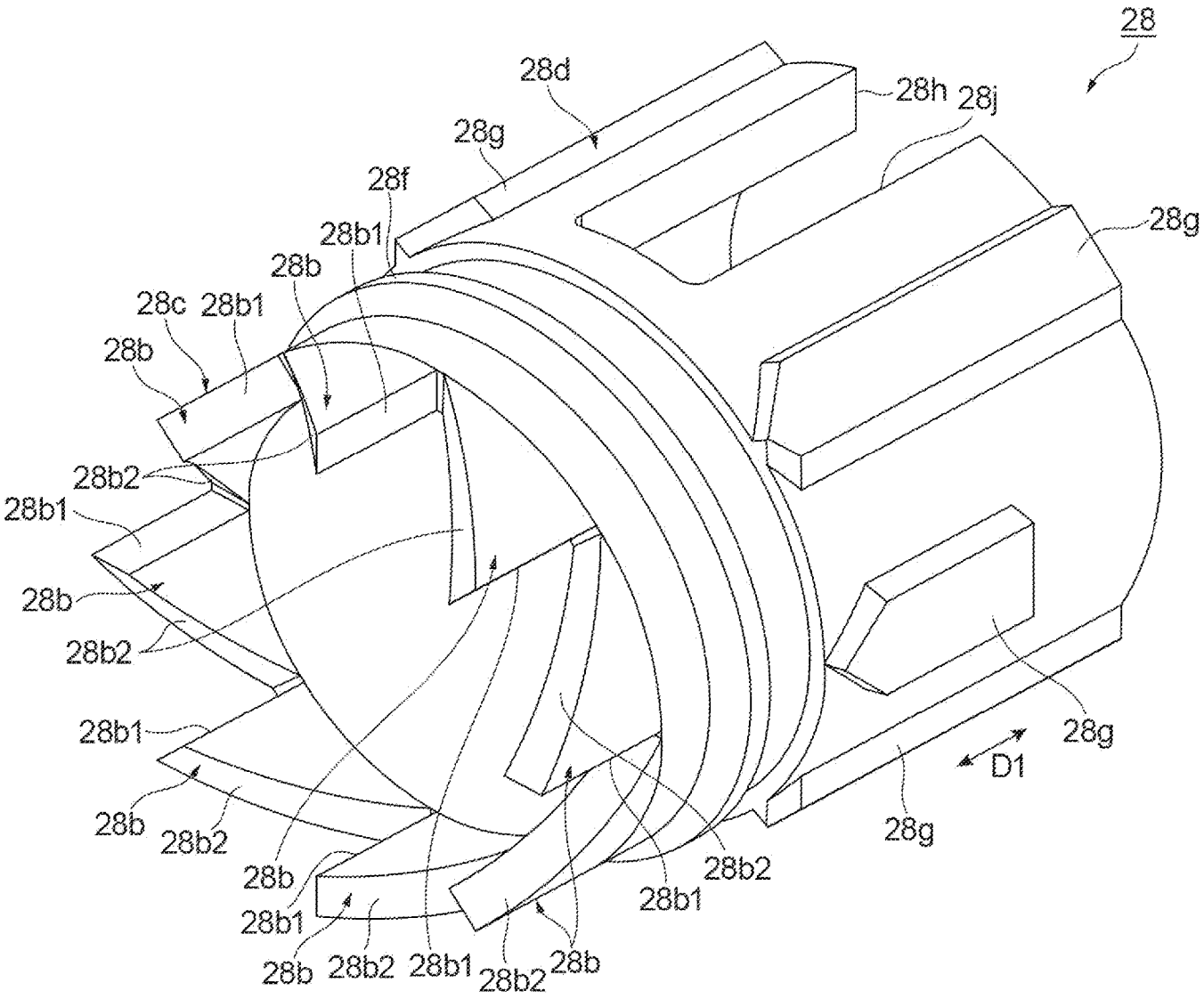
FIG. 10 is a perspective view illustrating the ratchet member of FIG. 9A.

FIG. 9A is a side view illustrating the ratchet member 28. FIG. 9B is a cross-sectional view taken along line D-D of FIG. 9A. FIG. 10 is a perspective view illustrating the ratchet member 28. As illustrated in FIGS. 1A, 1B, 9A, 9B, and 10, the ratchet member 28 exhibits a stepped cylindrical shape. The ratchet member 28 may be made of PBT or POM, for example.

The ratchet member 28 has a first engaging portion 28*c* with which the rotating member 27 is engaged and a second engaging portion 28*d* engaged with the main body tube 2. The first engaging portion 28*c* is located at the front end of the ratchet member 28. The first engaging portion 28*c* has the plurality of third teeth 28*b* with which the fourth teeth 27*p* of the rotating member 27 are engaged. As an example, the first engaging portion 28*c* has eight third teeth 28*b*. Each of the third teeth 28*b* has a sixth surface 28*b*1 extending in the axial direction D1 and an inclined surface 28*b*2 extending backward from the front end of the sixth surface 28*b*1 and one side of the ratchet member 28 in the circumferential direction.

For example, a length of the third tooth 28*b* of the ratchet member 28 in the circumferential direction is the same as a length of the fourth tooth 27*p* of the rotating member 27 in the circumferential direction. The third teeth 28*b* are provided to rotate the rotating member 27 with respect to the ratchet member 28. An inclination angle of the inclined surface 28*b*2 with respect to the axial direction D1 is the same as an inclination angle of the inclined surface 27*p*2 with respect to the axial direction D1.

The rotating member 27 is movable in the axial direction D1 with respect to the ratchet member 28. When the rotating member 27 moves backward, each of the fourth teeth 27*p* is engaged with a corresponding one of the third teeth 28*b*, and the inclined surface 27*p*2 abuts on the inclined surface 28*b*2, so that the rotating member 27 rotates at a certain angle with respect to the ratchet member 28 with this abutting.

The second engaging portion 28*d* is located behind the first engaging portion 28*c*. The second engaging portion 28*d* has an annular convex portion 28*f* and a plurality of convex portions 28*g* located behind the annular convex portion 28*f* and aligned along the circumferential direction of the ratchet member 28. The annular convex portion 28*f* abuts on a convex portion 2*b* formed on the inner surface of the main body tube 2 from the front to function as a stopper for the ratchet member 28 from the main body tube 2.

The convex portion 28*g* is engaged with a convex portion 2*c* formed on the inner surface of the main body tube 2 in the rotational direction. As a result, the ratchet member 28 is engaged with the main body tube 2 so as to be movable in the axial direction and immovable in the rotational direction (rotatable synchronously). The ratchet member 28 has a concave portion 28*j* extending forward from a rear end face 28*h*. The concave portion 28*j* is a portion into which a portion of the knock member 29 is inserted.

Figure 11A:
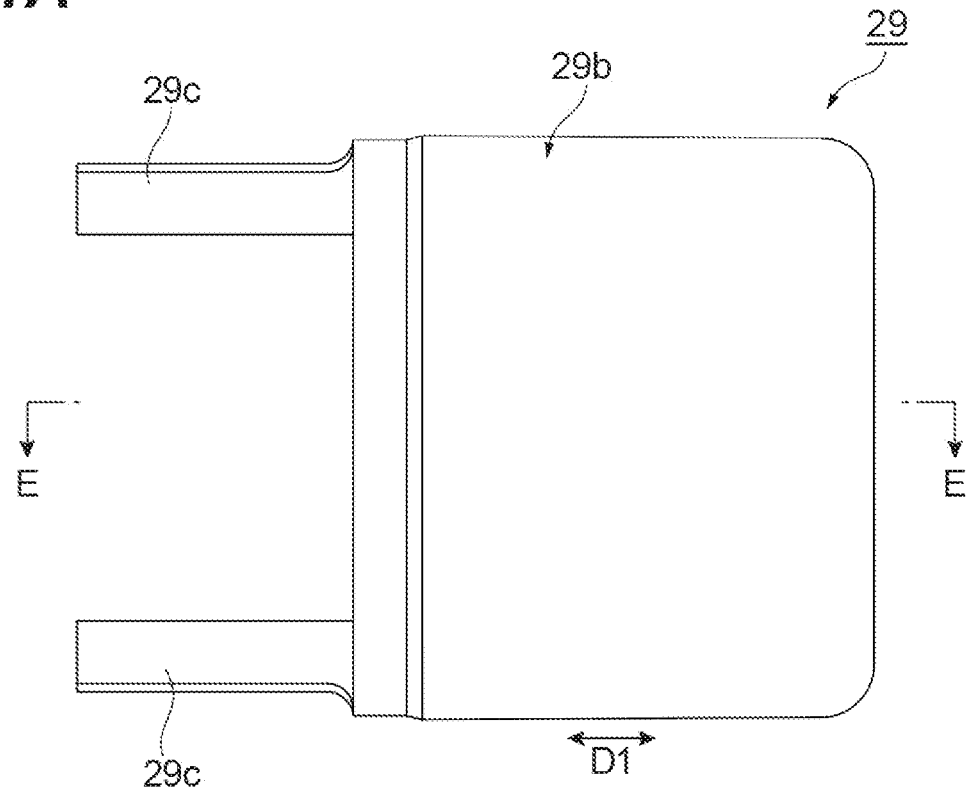
FIG. 11A is a side view illustrating a knock member of the cartridge-type content extrusion container of FIG. 1A.
Figure 11B:
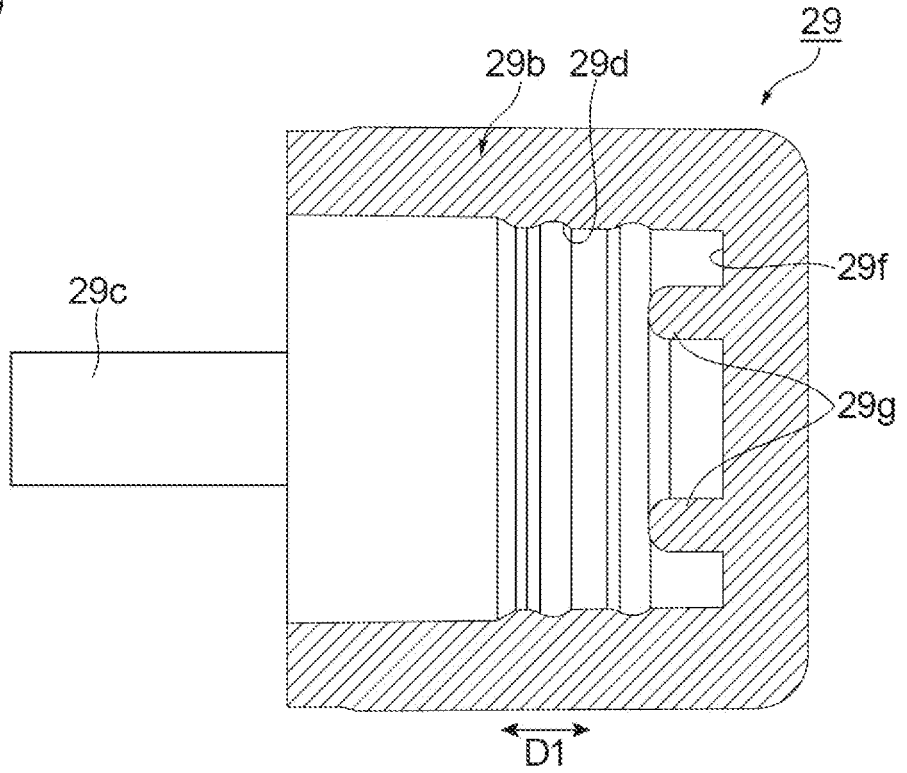
FIG. 11B is a cross-sectional view taken along a line E-E of FIG. 11A.

FIG. 11A is a side view illustrating the knock member 29. FIG. 11B is a cross-sectional view taken along a line E-E of FIG. 11A. As illustrated in FIGS. 1A, 1B, 11A, and 11B, the knock member 29 exhibits a bottomed tubular shape (as an example, a bottomed cylindrical shape). The knock member 29 is a portion that protrudes backward from a rear end face 2*d* of the main body tube 2 and is pressed forward by the user.

The knock member 29 has a tubular portion 29*b* having a bottomed tubular shape and a protruding portion 29*c* protruding from the tubular portion 29*b* in the axial direction D1. The tubular portion 29*b* has an annular concave-convex portion 29*d* formed on the inner peripheral surface and a plurality of convex portions 29*g* protruding from a bottom surface 29*f* of the tubular portion 29*b*. The convex portion 29*g* is a portion where a rear end face 27*r* of the rotating member 27 comes into contact. The annular concave-convex portion 29*d* is engaged with the annular concave portion 27*q* of the rotating member 27 in the axial direction D1. As a result, the knock member 29 is engaged with the rotating member 27 in the axial direction D1 and moves along the axial direction D1 together with the rotating member 27.

The knock member 29 has a pair of the protruding portions 29*c* aligned along the radial direction D2. The protruding portion 29*c* is a portion that is inserted into the concave portion 28*j* of the ratchet member 28. As the protruding portion 29*c* is inserted into the concave portion 28*j*, the protruding portion 29*c* is engaged with the concave portion 28*j* in the rotational direction. As a result, the knock member 29 is engaged with the ratchet member 28 so as to be movable in the axial direction and immovable in the rotational direction.

Figure 12A:
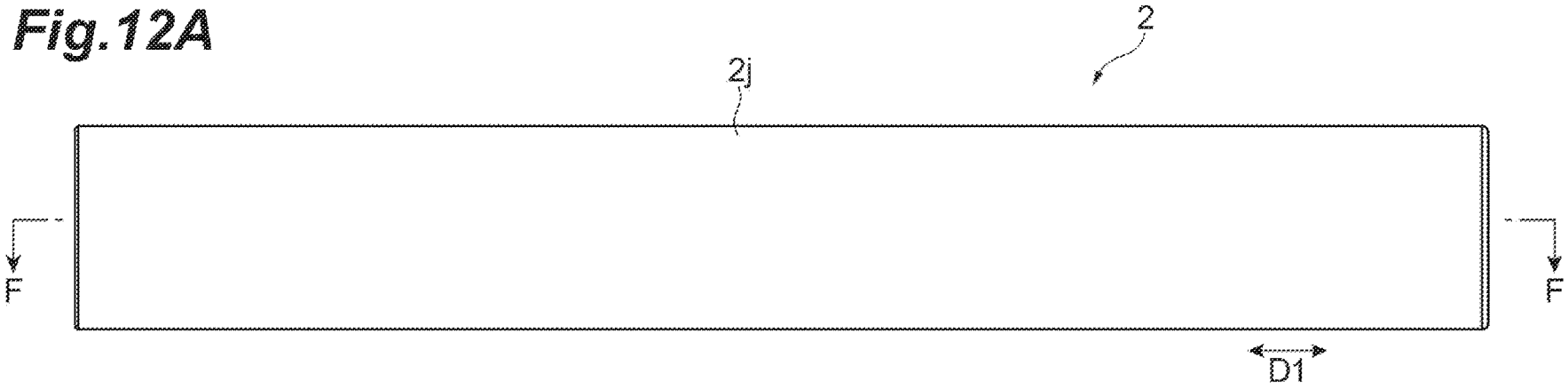
FIG. 12A is a side view illustrating the main body tube of the cartridge-type content extrusion container of FIG. 1A.
Figure 12B:
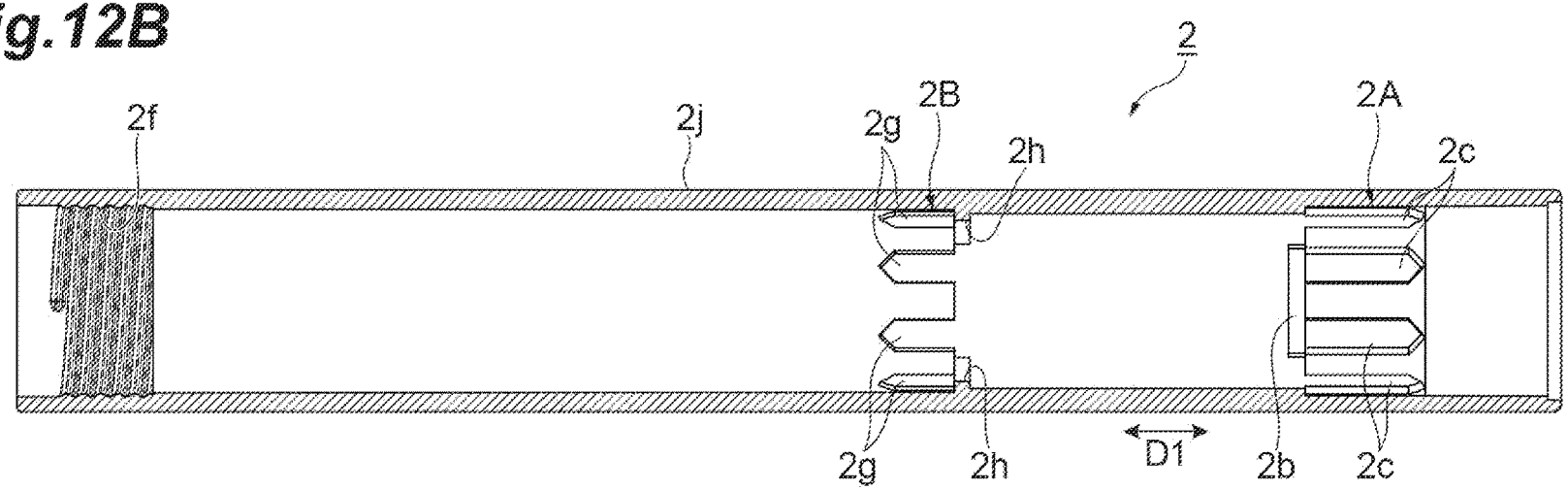
FIG. 12B is a cross-sectional view taken along line F-F of FIG. 12A.

FIG. 12A is a side view illustrating the main body tube 2. FIG. 12B is a cross-sectional view taken along a line F-F of FIG. 12A. As illustrated in FIGS. 1A, 12A, and 12B, the main body tube 2 has a smooth outer peripheral surface 2*j*. That is, the outer peripheral surface 2*j* has a smooth shape having no unevenness.

On the inner surface of the main body tube 2, there are a first engaging portion 2A with which the ratchet member 28 is engaged, a second engaging portion 2B with which the screw tube 22 is engaged, and a female screw portion 2*f* to which the cartridge unit 10 is attached. The first engaging portion 2A, the second engaging portion 2B, and the female screw portion 2*f* are aligned in this order from the rear to the front.

The first engaging portion 2A has the convex portion 2*b* on which the annular convex portion 28*f* of the ratchet member 28 abuts from the front and a plurality of the convex portions 2*c* aligned along the circumferential direction of the main body tube 2 at the rear portion of the convex portion 2*b*. The convex portion 2*b* extends in the circumferential direction of the main body tube 2, and the convex portion 2*c* extends in the axial direction D1. The second engaging portion 2B has a plurality of convex portions 2*g* with which the convex portions 22*t* of the screw tube 22 are engaged in the rotational direction and a convex portion 2*h* with which the annular concave portion 22*v* and an annular convex portion 22*w* of the screw tube 22 are engaged in the axial direction D1.

The convex portion 2*g* extends in the axial direction D1, and the convex portion 2*h* extends in the circumferential direction of the main body tube 2 at the rear end of the convex portion 2*g*. The female screw portion 2*f* is formed on a front side portion of the main body tube 2. By screwing of the male screw portion 12*c* of the cartridge tube 12 into the female screw portion 2*f*, the cartridge unit 10 (cartridge tube 12) is attached to the main body tube 2.

The procedure for extruding the content M in the cartridge-type content extrusion container 1 configured as described above and the procedure for using the cartridge-type content extrusion container 1 will be described. First, the cap 11 is removed from the cartridge-type content extrusion container 1 to expose the cartridge tube 12, the sleeve 13, and the coating body 14.

When the knock member 29 is pressed forward, the rotating member 27 advances against the biasing force of the second spring 25, and each of the second teeth 27*k* of the rotating member 27 abuts on a corresponding one of the first teeth 22*x* of the screw tube 22. At this time, as illustrated in FIGS. 1A, 3A, and 7A, the inclined surface 27*k*2 of the second tooth 27*k* abuts on the inclined surface 22*x*2 of the first tooth 22*x*, and the rotating member 27 rotates in one direction (for example, in the clockwise direction when viewed from the rear) with respect to the screw tube 22. At this time, the second tooth 27*k* is inserted into the concave portion 22*y*, and the third surface 27*k*1 abuts on the second surface 22*x*3, so that a clicking sound of "click" is generated. When the rotating member 27 rotates in one direction with respect to the screw tube 22, the moving body 21 together with the rotating member 27 rotates in one direction.

In addition, when the pressure applied on the knock member 29 is released, the rotating member 27 moves backward due to the biasing force of the second spring 25, and each of the fourth teeth 27*p* of the rotating member 27 abuts on a corresponding one of the third teeth 28*b* of the ratchet member 28. At this time, as illustrated in FIGS. 1A, 1B, 7A, and 9A, the inclined surface 27*p*2 of the fourth tooth 27*p* abuts on the inclined surface 28*b*2 of the third tooth 28*b*, the rotating member 27 rotates in one direction with respect to the ratchet member 28. When the rotating member 27 rotates in one direction with respect to the ratchet member 28, the moving body 21 together with the rotating member 27 rotates in one direction.

As described above, when the knock member 29 is pressed, the rotating member 27 rotates in one direction with respect to the screw tube 22, and when the pressing on the knock member 29 is released, the rotating member 27 rotates in one direction with respect to the ratchet member 28. As an example, the rotating member 27 is rotated by 45° by pressing and releasing of pressing of the knock member 29 once.

When the moving body 21 rotates in one direction in this manner, the moving body 21 advances with respect to the screw tube 22 by the screwing function of the female screw 22*b* and the male screw 21*b*. As the moving body 21 advances, the piston 17 advances in the accommodation chamber 12*f* of the cartridge tube 12, and the content M is supplied to the coating body 14 for use by this advance. In the cartridge-type content extrusion container 1, the moving body 21 can be advanced both when the knock member 29 is pressed and when the pressing on the knock member 29 is released.

Figure 13:
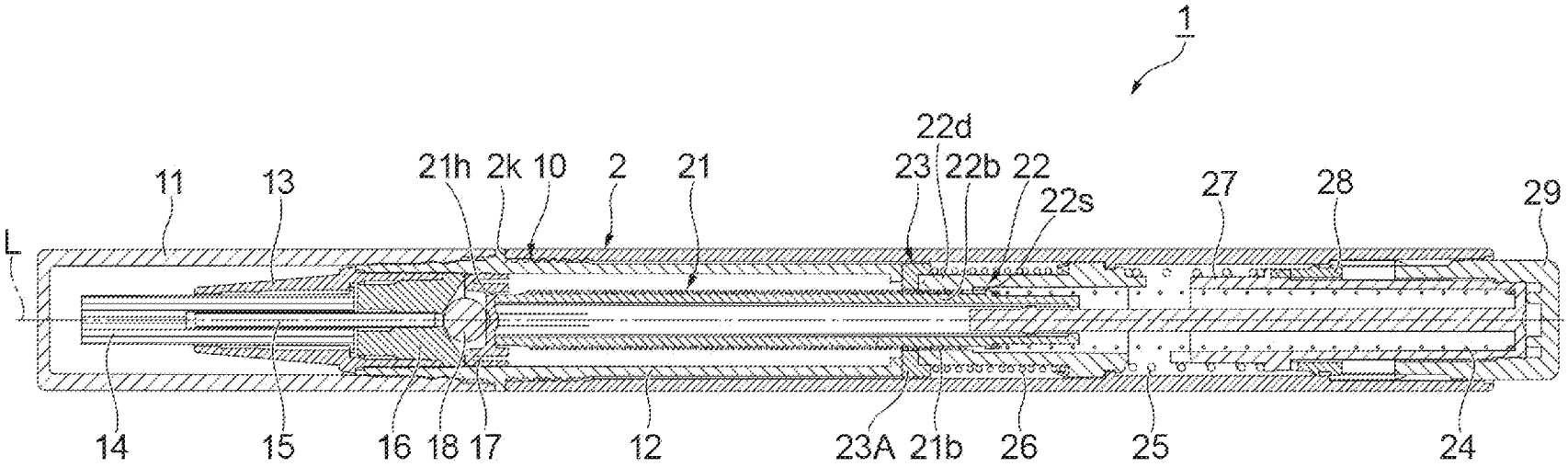
FIG. 13 is a cross-sectional view of a cartridge-type content extrusion container illustrating a state in which a content of the cartridge-type content extrusion container of FIG. 1A is used up.

FIG. 13 is a cross-sectional view of the cartridge-type content extrusion container 1 in which the content M is used up. As illustrated in FIG. 13, the piston 17 comes into contact with the pipe holder 16 in a state where the moving body 21 advances and the content M is used up. In the cartridge-type content extrusion container 1, the cartridge unit 10 in which the content M has been used up can be removed from the main body tube 2, and the new cartridge unit 10 can be attached to the main body tube 2. Hereinafter, the movement of each component when the cartridge unit 10 is removed from the main body tube 2 and the movement of each component when the new cartridge unit 10 is attached to the main body tube 2 will be described.

First, when the cartridge unit 10 is removed from the main body tube 2, the cartridge tube 12 is removed from the main body tube 2 by rotating the cartridge unit 10 with respect to the main body tube 2. At this time, the screw adjusting member 23 advances with respect to the screw tube 22 due to the biasing force of the third spring 26.

As illustrated in FIGS. 3A, 5B, and 13, when the screw adjusting member 23 advances with respect to the screw tube 22, the annular portion 23A riding on the screw tube 22 advances, and the projecting portion 23*h* of the arm portion 23B abuts on the abutting portion 22*s* of the elastic portion 22*d*. The elastic portion 22*d* is expanded outward in the radial direction D2 by the abutting of the projecting portion 23*h* on the abutting portion 22*s*, and thus, the screwing of the female screw 22*b* with the male screw 21*b* is released. When the screwing of the female screw with the male screw 21*b* is released, the moving body 21 moves forward due to the biasing force of the first spring 24. At this time, a front end 21*h* of the moving body 21 is in a state of protruding forward from a front end 2*k* of the main body tube 2.

Next, the movement of the components when the new cartridge unit 10 is attached to the main body tube 2 will be described. As illustrated in FIGS. 1A, 1B, 3A, 3B, and 5B, the piston 17 of the cartridge unit 10 is allowed to hit the front end 21*h* of the moving body 21, the cartridge tube 12 is inserted into the main body tube 2, and the moving body 21 is pushed backward to screw the male screw portion 12*c* into the female screw portion 2*f*.

At this time, the moving body 21 moves backward against the biasing force of the first spring 24. Further, the screw adjusting member 23 is pushed by the cartridge tube 12 and moves backward, and the annular portion 23A abuts on the abutting portion 22*c* of the screw tube 22. At this time, the annular portion 23A rides over the inclined surface 22*j* backward and rides on the elastic portion 22*d*.

In this manner, the annular portion 23A moves backward and rides on the elastic portion 22*d*, so that the elastic portion 22*d* is pressed inside the radial direction D2, and the female screw 22*b* is screwed into the male screw 21*b*. By removing the cap 11 and pressing (knocking) the knock member 29 in this state, as described above, the moving body 21 and the piston 17 move forward and the content M is supplied to the coating body 14, so that the cartridge-type content extrusion container 1 is supplied for using.

Next, the function and effect obtained from the example cartridge-type content extrusion container 1 will be further described. The cartridge-type content extrusion container 1 has the cartridge unit 10 accommodating the content M and the main body tube 2 to which the cartridge unit 10 is attached, and the cartridge unit 10 is removably attached (e.g., attachable to and detachable from) the main body tube 2. Therefore, after the content M is used up, it is preferable that the cartridge unit 10 is removed from the main body tube 2 and only the cartridge unit 10 is discarded, so that the number of discarded components can be reduced.

The cartridge-type content extrusion container 1 includes the screw tube 22 having an elastic portion 22*d* elastically deformed in the radial direction D2, a moving body 21 having a male screw 21*b* screwed into a female screw 22*b* of the screw tube 22 and advancing to extrude the content M inside the cartridge unit 10, a rotating member 27 rotating synchronously with the moving body 21, and a knock member 29 that is pressable. The rotating member 27 has second teeth 27*k* that are engaged with the first teeth 22*x* provided inside the main body tube 2. When the knock member 29 is pressed, the rotating member 27 advances and the second teeth 27*k* are engaged with the first teeth 22*x*, the rotating member 27 and the moving body 21 rotate with respect to the screw tube 22, so that the moving body 21 advances.

Therefore, since the rotating member 27 and the moving body 21 can be rotated with respect to the screw tube 22 by the pressing operation of the knock member 29 and the moving body 21 can be advanced along with the rotation to extrude the content M, the usability of the cartridge-type content extrusion container 1 can be improved. That is, since the content M can be extruded by holding the cartridge-type content extrusion container 1 with one hand and pressing the knock member 29 with one hand, the cartridge-type content extrusion container 1 with high usability can be obtained. As described above, in the cartridge-type content extrusion container 1, since the content M can be extruded by knocking, the usability can be further improved.

The example cartridge-type content extrusion container 1 has the first spring 24 that biases the moving body 21 forward. Therefore, when the cartridge unit 10 is removed from the main body tube 2, the moving body 21 can be moved forward by the first spring 24.

The example cartridge-type content extrusion container 1 has a second spring 25 which is provided between the screw tube 22 and the rotating member 27 and, when the pressing on the knock member 29 is released, moves the rotating member 27 and the knock member 29 backward. Therefore, when the pressing on the knock member 29 is released, the rotating member 27 and the knock member 29 can be moved backward by the second spring 25.

The example cartridge-type content extrusion container 1 has the ratchet member 28 provided between the rotating member 27 and the knock member 29 and having the plurality of third teeth 28*b* aligned along the circumferential direction. The rotating member 27 has the fourth teeth 27*p* that are aligned along the circumferential direction and engaged with the third teeth 28*b*. When the pressing on the knock member 29 is released, the rotating member 27 moves backward to allow the fourth teeth 27*p* to be engaged with the third teeth 28*b*, and the rotating member 27 and the moving body 21 rotate with respect to the ratchet member 28, so that the screwing function between the male screw 21*b* and the female screw 22*b* works to allow the moving body 21 to advance. Therefore, not only when the knock member 29 is pressed but also when the pressing on the knock member 29 is released, the moving body 21 can be advanced, so that the content M can be extruded. Accordingly, the usability of the cartridge-type content extrusion container 1 can be further improved.

The example cartridge-type content extrusion container 1 has a third spring 26 which is provided between the screw adjusting member 23 and the screw tube 22 and, when the cartridge unit 10 is removed from the main body tube 2, advances the screw adjusting member 23. Therefore, when the cartridge unit 10 is removed from the main body tube 2, by advancing the screw adjusting member 23 by the third spring 26, the elastic portion 22*d* can be expanded in the radial direction D2 to easily release the screwing between the female screw 22*b* and the male screw 21*b*.

When the example cartridge unit 10 is attached to the main body tube 2, the screw adjusting member 23 is pushed by the cartridge unit 10 to move backward, and the elastic portion 22*d* of the screw tube 22 is narrowed in the radial direction D2 to screw the female screw 22*b* into the male screw 21*b*. Therefore, when the cartridge unit 10 is attached, since the screw adjusting member 23 moves backward to screw the female screw 22*b* into the male screw 21*b*, the screwing of the female screw 22*b* into the male screw 21*b* can be easily performed.

The example cartridge unit 10 has the accommodation chamber 12*f* accommodating the content M and the piston 17 provided in the accommodation chamber 12*f*. The moving body 21 extrudes the content M through the piston 17. Therefore, when the content M is a liquid content, the piston 17 can suppress the leakage of the liquid content. Then, the liquid content can be extruded through the piston 17.

It is to be understood that not all aspects, advantages and features described herein may necessarily be achieved by, or included in, any one particular example. Indeed, having described and illustrated various examples herein, it should be apparent that other examples may be modified in arrangement and detail is omitted. That is, the configuration, shape, size, material, and arrangement mode of each component constituting the cartridge-type content extrusion container can be appropriately changed within the scope of the above-described spirit.

For example, in the description above, an example in which the screw tube 22 has the first teeth 22*x* has been described. However, the first teeth may be provided at a position other than the screw tube 22. That is, the first teeth may be separate from the screw tube 22. For example, a plurality of the first teeth may be formed on the inner surface of the main body tube 2 along the circumferential direction of the main body tube 2. In this manner, the type and location of the components provided with the first teeth can be changed as appropriate.

Additionally, in the examples described above, the knock mechanism unit 20 having the first spring 24, the second spring 25, and the third spring 26 has been described. However, the cartridge-type content extrusion container may have the knock mechanism unit that does not have at least one of the first spring 24, the second spring 25, and the third spring 26. Instead of the first spring 24, the moving body 21 may be manually advanced when the female screw 22*b* is screw-released from the male screw 21*b*. Further, instead of the third spring 26 that biases the screw adjusting member 23 forward, another component may advance the screw adjusting member 23 forward, and for example, the cartridge tube 12 has a mechanism moving the screw adjusting member 23 forward.

Also, in the examples described above, the knock mechanism unit 20 including the ratchet member 28 having the third teeth 28*b* has been described. However, instead of the ratchet member 28, a tubular member having no teeth may be provided. Further, in the examples described above, the cartridge-type content extrusion container 1 on which the cartridge unit 10 accommodating the content M, which is a liquid cosmetic material, is attached has been described. However, the content may be other than a liquid cosmetic material. For example, the content may be a liquid drawing material such as ink. Further, the content may be other than a liquid content, and the content may be a bar-shaped cosmetic material or a bar-shaped drawing material. In this case, a configuration can be provided in which the piston 17 can be omitted in the cartridge unit, and the moving body 21 can directly push the content M. In this manner, the type of content can be changed as appropriate.

What is claimed is:

1. A cartridge-type content extrusion container comprising:

a cartridge containing a material and forming an opening;

a main body tube to removably accommodate the cartridge;

a screw tube provided inside the main body tube, having an elastic portion that is elastically deformable in a radial direction of the main body tube;

a moving body that is screwed into the screw tube to move in an axial direction of the main body tube via a rotation of the moving body relative to the screw tube, to urge the material toward the opening of the cartridge;

a plurality of first teeth that are synchronously rotatable with the screw tube and arranged along a circumferential direction of the main body tube;

a rotating member that is synchronously rotatable with the moving body, wherein the rotating member has a plurality of second teeth that are engaged with the first teeth to convert an axial movement of the rotating member into a rotational movement of the moving body relative to the screw tube;

a pressable knock actuator to move the rotating member in the axial direction so as to urge the moving body to extrude the material out from the cartridge via the rotational movement of the moving body; and a screw locking member to accommodate the elastic portion of the screw tube, wherein the screw locking member is movable away from the screw tube when the cartridge is removed from the main body tube to cause the elastic portion to expand in the radial direction so as to release a screw coupling between the screw tube and the moving body.

2. The cartridge-type content extrusion container according to claim 1, further comprising a forward spring to bias the moving body toward the opening of the cartridge in the axial direction.

3. The cartridge-type content extrusion container according to claim 1, further comprising a rearward spring provided between the screw tube and the rotating member to bias the rotating member and the knock actuator away from the moving body in response to a release of pressure applied on the knock actuator.

4. The cartridge-type content extrusion container according to claim 1, further comprising a ratchet member provided between the rotating member and the knock actuator and having a plurality of third teeth aligned along the circumferential direction, wherein the rotating member has a plurality of fourth teeth that are aligned along the circumferential direction and engaged with the third teeth, to cause a rotation of the rotating member and of the moving body with respect to the ratchet member, in response to a release of pressure applied on the knock actuator, to further move the moving body toward the opening of the cartridge.

5. The cartridge-type content extrusion container according to claim 1, further comprising a release spring provided between the screw locking member and the screw tube to urge the screw locking member away from the screw tube when the cartridge is removed from the main body tube.

6. The cartridge-type content extrusion container according to claim 1, wherein the cartridge is configured to, when the cartridge is attached to the main body tube, urge the screw locking member to accommodate the elastic portion of the screw tube and limit the deformation of the elastic portion in the radial direction, to lock the screw coupling of the moving body with the screw tube.

7. The cartridge-type content extrusion container according to claim 1, wherein the cartridge has an accommodation chamber accommodating the material and a piston provided in the accommodation chamber, and wherein the moving body is coupled to the piston to extrude the material from the cartridge via a movement of the piston.

8. The cartridge-type content extrusion container according claim 1, wherein the elastic portion of the screw tube has an inner surface that forms a female screw, and wherein the moving body has an outer surface forming a male screw to engage with the female screw of the elastic portion.

9. The cartridge-type content extrusion container according claim 1, wherein the plurality of first teeth are formed on the screw tube.

* * * * *